US012000607B2

(12) United States Patent
Sabat et al.

(10) Patent No.: US 12,000,607 B2
(45) Date of Patent: Jun. 4, 2024

(54) HVAC CONTROL SYSTEM AND METHOD

(71) Applicant: KEPsmart, Inc., Eatontown, NJ (US)

(72) Inventors: Peter Sabat, Rumson, NJ (US); Thaddeus Bielenda, Matawan, NJ (US); Emil Del Prete, Rumson, NJ (US)

(73) Assignee: KEPSMART, INC., Eatontown, NJ (US)

( * ) Notice: Subject to any disclaimer, the term of this patent is extended or adjusted under 35 U.S.C. 154(b) by 0 days.

(21) Appl. No.: 17/102,929

(22) Filed: Nov. 24, 2020

(65) Prior Publication Data

US 2021/0156583 A1 May 27, 2021

Related U.S. Application Data

(60) Provisional application No. 62/940,028, filed on Nov. 25, 2019.

(51) Int. Cl.
*F24F 11/47* (2018.01)
*F24F 11/58* (2018.01)
(Continued)

(52) U.S. Cl.
CPC ..... *F24F 11/47* (2018.01); *F24F 11/58* (2018.01); *F24F 11/67* (2018.01); *F24F 2110/10* (2018.01)

(58) Field of Classification Search
CPC .. F24F 11/47; F24F 11/58; F24F 11/67; F24F 2110/10
See application file for complete search history.

(56) References Cited

U.S. PATENT DOCUMENTS 7,156,316 B2 1/2007 Kates
8,160,729 B2 4/2012 Ahmed
(Continued)

FOREIGN PATENT DOCUMENTS

CA 2885868 A1 4/2014
DE 10126475 A1 3/2003
(Continued)

OTHER PUBLICATIONS

"Autonomous AI HVAC Technology: The Beginning Of A New Era In Building Automation", Brainbox AI Retrieved from: https://www.brainboxai.com/ Retrieved on Oct. 9, 2019 (22 pages total).
(Continued)

*Primary Examiner* — Christopher W Carter
(74) *Attorney, Agent, or Firm* — John Maldjian, Esq.; David L. D'Amato, Esq.; Stevens & Lee PC

(57) ABSTRACT

A Heating, Ventilation, And Air-Conditioning (HVAC) system comprising: a plurality of external sensors; a plurality of internal sensors; a plurality of valve control boxes; a Smart Metering Unit (SMU) connected to the external sensors, the internal sensors, and the valve control boxes, configured to: receive the sensed data form the external sensors, and the internal sensors; transmit, wirelessly, the received sensed data to a cloud server through a Lobby Control Unit (LCU) over a communication network; receive rules generated by a management platform of the cloud server, wherein the rules are generated by the management platform by using an Artificial Intelligence (AI) algorithm; and transmit the received rules to the plurality of valve control boxes to control the operation of the actuator valves installed at the radiators to turn on and/or turn off a heating and/or a cooling of one or more virtual HVAC zones of the building.

17 Claims, 13 Drawing Sheets

(51) Int. Cl.
*F24F 11/67* (2018.01)
*F24F 110/10* (2018.01)

(56) References Cited

U.S. PATENT DOCUMENTS

| | | | | |
|---|---|---|---|---|
| 9,182,142 | B2 | 11/2015 | Wen | |
| 9,429,923 | B2 | 8/2016 | Ward et al. | |
| 9,684,312 | B1 * | 6/2017 | Eyring | G01D 4/00 |
| 9,791,839 | B2 | 10/2017 | Matsuoka et al. | |
| 10,094,586 | B2 | 10/2018 | Pavlovski et al. | |
| 10,274,916 | B2 | 4/2019 | Shen et al. | |
| 10,298,411 | B2 | 5/2019 | Donlan et al. | |
| 2003/0171851 | A1 | 9/2003 | Brickfield et al. | |
| 2009/0187445 | A1 * | 7/2009 | Barclay | G06Q 50/06 702/60 |
| 2013/0013120 | A1 | 1/2013 | Sabripour | |
| 2013/0338837 | A1 * | 12/2013 | Hublou | G05D 23/1923 700/278 |
| 2014/0058572 | A1 * | 2/2014 | Stein | H02J 13/00004 700/291 |
| 2014/0260965 | A1 | 9/2014 | Finkam | |
| 2014/0277765 | A1 | 9/2014 | Karimi et al. | |
| 2015/0178865 | A1 | 6/2015 | Anderson et al. | |
| 2018/0119973 | A1 | 5/2018 | Rothman et al. | |
| 2018/0225585 | A1 | 8/2018 | Dong et al. | |
| 2018/0364654 | A1 * | 12/2018 | Locke | F24F 11/63 |
| 2018/0372363 | A1 * | 12/2018 | Park | F24F 11/63 |
| 2019/0271483 | A1 * | 9/2019 | Joo | F24F 11/52 |
| 2020/0378352 | A1 | 12/2020 | Cosgrove et al. | |
| 2021/0041119 | A1 | 2/2021 | Pham et al. | |

FOREIGN PATENT DOCUMENTS

| | | | |
|---|---|---|---|
| EP | 3428747 | A1 | 7/2018 |
| JP | 2006132883 | A | 5/2006 |
| WO | 2016148651 | A1 | 9/2016 |
| WO | 2019070192 | A1 | 4/2019 |

OTHER PUBLICATIONS

ConnectM "Sensor Data Platfrom for Connected Assets" Retreived from: https://www.connectm.com/ Retrieved on Oct. 9, 2019 (4 pages total).

Prof. Dr. OmPrakash G. Kulkarni, "The Future of HVAC is AI and IIoT/IoT?" Jan. 16, 2019 Retrieved from: https://www.coolingindia.in/the-future-of-hvac-is-ai-and-iiot-iot/ Retrieved on: Oct. 9, 2019 (13 pages total).

Adhikary, et al., "Application of Artificial Intelligencein Energy Efficient H.V.A.C. System Design: A Case Study", ARPN Journal of Engineering and Applied Sciences, vol. 12, No. 21, Nov. 2017 (5 pages total).

Gao, et al., "Energy-Efficient Thermal Comfort Control in Smart Buildings via Deep Reinforcement Learning" Jan. 15, 2019 Retrieved from: https://arxiv.org/abs/1901.04693 Retrieved on Oct. 9, 2019 (11 pages total).

Ambi Climate, "Personalized Comfort Made Easy with AI" Retrieved from: https://www.ambiclimate.com/en/ Retrieved on Oct. 9, 2019 (6 pages total).

Jeong Chul Park, "Aircleaner having an aroma generator and control method of it" (translation), Apr. 24, 2006, ip.com translation (Year: 2006) (8 pages total).

* cited by examiner

802

804

106

110

HVAC CONTROL SYSTEM AND METHOD

CROSS REFERENCE TO RELATED APPLICATION

This application claims benefit and priority to U.S. Provisional Patent Application Ser. No. 62/940,028, filed Nov. 25, 2019, entitled, "HVAC CONTROL SYSTEM AND METHOD" which is incorporated herein by reference in its entirety.

FIELD OF TECHNOLOGY

Embodiments of the present invention generally relate to systems and methods for controlling and monitoring heating, ventilation, and air-conditioning of a building for occupant comfort across multiple HVAC zones with the ability for a granular and customizable control.

BACKGROUND

A modern multiple floor building system has numerous energy requirements such as, but not limited to, controlling energy consumption, and reducing costs of energy consumption, and providing comfort to its occupants and so forth. Systems such as Heat, Ventilation and Air conditioning (HVAC) are installed in these multiple floor buildings to meet these requirements along with the comfort, cost, and efficiency of the energy requirements. HVAC is a technology of indoor and vehicular environmental comfort, which provides thermal comfort and acceptable indoor air quality.

Due to rising cost of fossil fuels and environmental concerns, decreasing the energy consumption of heating, ventilation and air conditioning gets increasingly important. Wireless sensor networks, equipped with temperature, humidity, and multiple other sensors, are nowadays a basic platform to build automated HVAC systems but the conventional HVAC systems lacks division of floors of a building into multiple HVAC zones, preventing buildings from reaching optimal energy efficiency, etc. The heating or cooling is either on an "all on" state or an "all off" state across the multiple floors without having an ability for a granular control. The conventional systems create cold areas or cold floors or super-heated areas or floors with no control and efficiency. In an exemplary scenario, a problem may be that a tenant in a building might need heating or cooling for the weekend or after hours. Therefore, the conventional systems in a two HVAC zoned 40 story building may heat or cool 20 floors for just 1 tenant. Even the unoccupied floors are heated or cooled without the ability to bypass them thereby causing more energy consumption and more carbon footprint with an inherent design flaw that no one has yet addressed.

Conventional HVAC systems account for a large portion of energy consumption and carbon dioxide emission. Also, these systems are expensive to install and operate. Further, many big cities around the world are facing a carbon challenge reduction that requires major building owners to lower their carbon footprint by 40%-80% in the upcoming years. Furthermore, the conventional systems divide the buildings in fewer zones and further, do not automatically shut off or turn on the heat/cold if a floor of a building is empty. These conventional systems divide buildings into very few zones. A user or an occupant of a building must be provided with an approach having an energy management system based on energy consumption data obtained from modules monitoring and controlling the energy consumption.

Therefore, there is a need for a system and a method for monitoring and optimization of energy consumption in a building in a more efficient manner.

SUMMARY

Embodiments in accordance with the present invention provide a Heating, Ventilation, And Air-Conditioning (HVAC) system comprising: a plurality of external sensors to sense data associated with one or more external variables associated with an external environment of a building; a plurality of internal sensors configured to sense data associated with one or more internal variables from within the building; a plurality of valve control boxes to control an operation of one or more actuator valves installed at one or more radiators of the HVAC system; a Smart Metering Unit (SMU) connected to each of the plurality of external sensors, each of the plurality of internal sensors, and each of the plurality of valve control boxes, wherein the SMU is configured to: receive the sensed data form each of the plurality of external sensors, and each of the plurality of internal sensors; transmit, wirelessly, the received sensed data to a cloud server through a Lobby Control Unit (LCU) installed in the building over a communication network; receive one or more rules generated by a management platform of the cloud server through the LCU, wherein the one or more rules are generated by the management platform by using an Artificial Intelligence (AI) algorithm; and transmit the received one or more rules to the one or more of the plurality of valve control boxes to control the operation of the one or more actuator valves installed at the one or more radiators to turn on or turn off a heating and/or a cooling of one or more virtual HVAC zones of the building.

Embodiments in accordance with the present invention provide a method for controlling a Heating, Ventilation, And Air-Conditioning (HVAC) system, the method comprising steps of: receiving sensed data associated with one or more external variables of a building from each of the plurality of external sensors, and sensed data associated with one or more internal variables of the building from each of the plurality of internal sensors; transmitting, wirelessly, the received sensed data to a cloud server through a Lobby Control Unit (LCU) installed in the building over a communication network having a self-healing secured network with a built-in route optimization; receiving one or more rules generated by a management platform of the cloud server through the LCU, wherein the one or more rules are generated by the management platform by using an Artificial Intelligence (AI) algorithm; and transmitting the received one or more rules to a plurality of valve control boxes to control an operation of one or more actuator valves installed at one or more radiators to turn on or turn off a heating and/or a cooling of one or more virtual HVAC zones of the building.

Embodiments in accordance with the present invention provide a computing device configured to operate as a computer-implemented control and optimization tool for a Heating, Ventilation, And Air-Conditioning (HVAC) system, comprising: one or more processors; and one or more non-transitory computer-readable storage media storing instructions which, when executed by the one or more processors, cause the computing device to: receive sensed data associated with one or more external variables of a building from each of the plurality of external sensors, and sensed data associated with one or more internal variables of the building from each of the plurality of internal sensors; transmit, wirelessly, the received sensed data to a cloud server through a Lobby Control Unit (LCU) installed in the building over a communication network, wherein the communication network is a self-healing secured network with a built-in route optimization; receive one or more rules generated by a management platform of the cloud server through the LCU, wherein the one or more rules are generated by the management platform by using an Artificial Intelligence (AI) algorithm; and transmit the received one or more rules to a plurality of valve control boxes to control an operation of one or more actuator valves installed at one or more radiators to turn on or turn off a heating and/or a cooling of one or more virtual HVAC zones of the building.

Embodiments in accordance with the present invention may provide a number of advantages depending on its particular configuration. First, embodiments of the present invention provide a Heating, Ventilation, and Air-Conditioning (HVAC) system to monitor and daily improve an optimization of a usage of an energy in a building. Next, embodiments of the present invention provides a HVAC system that dramatically lowers an energy cost and creates a comfortable, controllable zone where before there were none. Further, embodiment of the present invention provides a HVAC system that uses an Artificial Intelligence (AI) model capable of continually getting smarter as more variations of data is collected and analyzed. Next, embodiments of the present invention provides the HVAC system that optimizes an energy used in a cooling or a heating a building, thus significantly lowering energy cost, and reducing the building's carbon footprint by turning a multi storied building with a few defined HVAC zones into an unlimited amount of HVAC zones without having to replace a piping within the building.

Accordingly, embodiments of the present invention provide a HVAC system with multiple virtual zones and high level of granularity that controls a usage of building energy on a three-dimensional scale and further lowers their carbon footprint. Embodiments of the present invention does not replace nor reconfigures the present piping within the building to provide reduced energy consumption while providing an acceptable level of comfort to an occupant. Furthermore, the purpose of saving energy may be solely fully filled and anywhere from 20% to 45% energy savings in the building may be achieved by utilizing the present system as each building may contain hundreds of virtual controllable heating/cooling zones running the AI Energy Management Solution for automation.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1A:
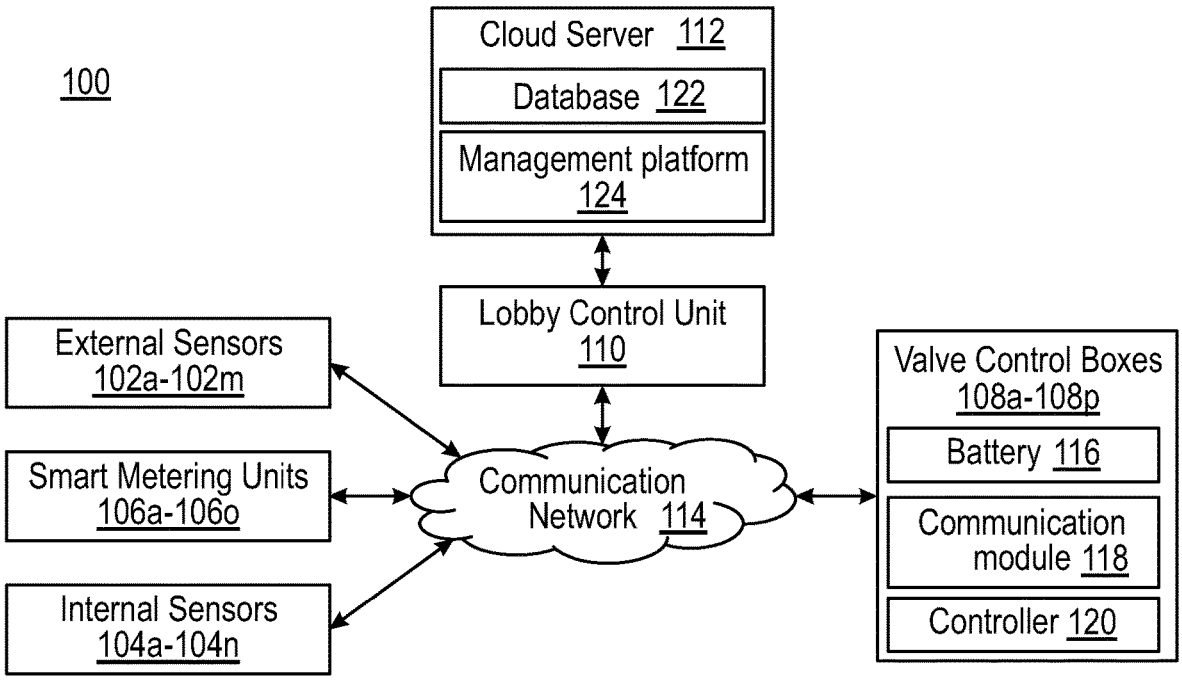
FIG. 1A illustrates a block diagram of a Heating, Ventilation, and Air-Conditioning (HVAC) system, according to an embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

Embodiments of the present invention are directed towards a system and a method for controlling and monitoring a Heating, Ventilation, and Air-Conditioning (HVAC) of a building having multiple virtual HVAC zones for occupant comfort with the ability for granular control. The HVAC system reads and analyzes data from sensors placed inside as well as outside the building.

Figure 1B:
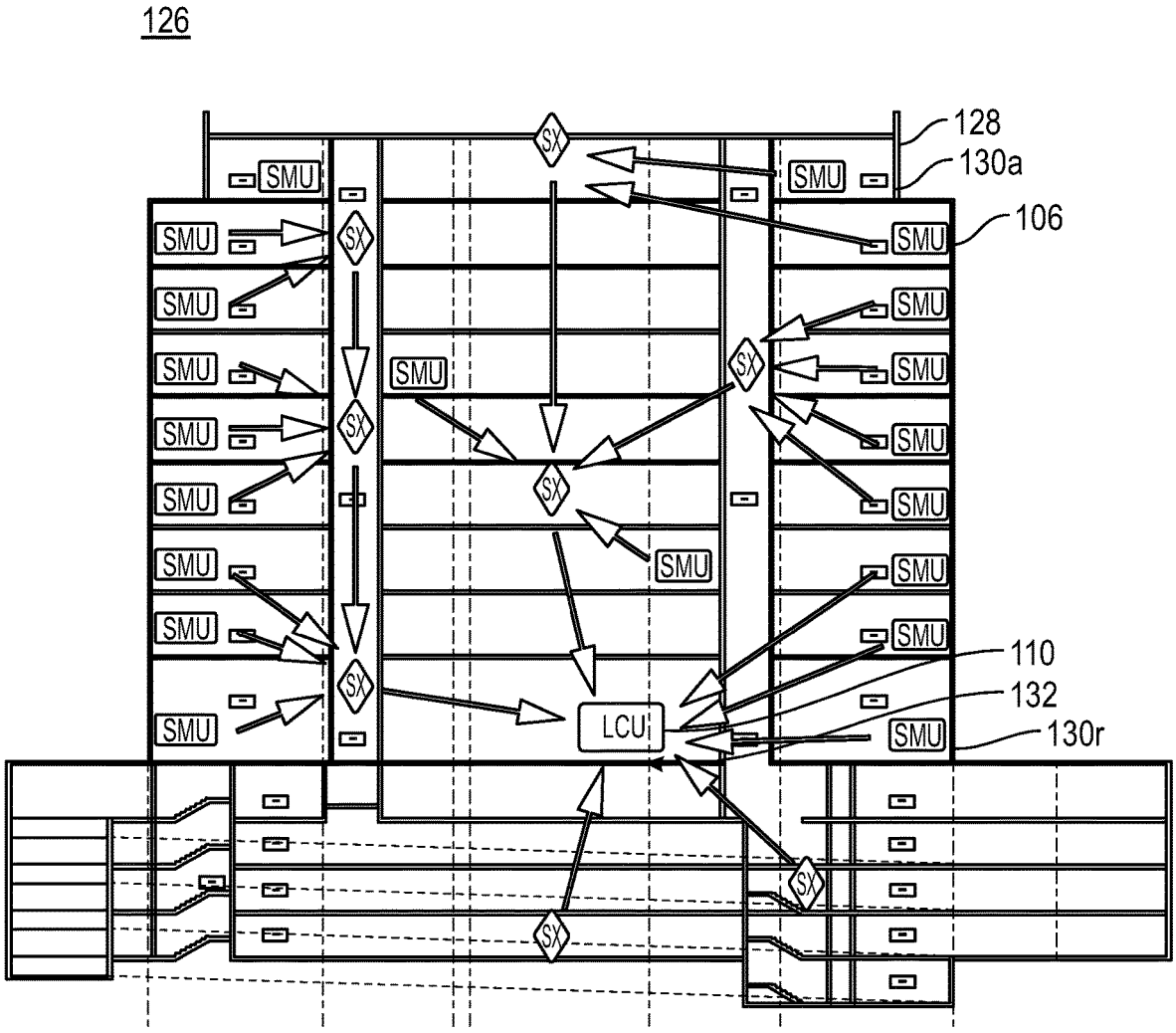
FIG. 1B illustrates an installation of the HVAC system in a building, according to an embodiment of the present invention.

FIG. 1A illustrates a block diagram of a Heating, Ventilation, And Air-Conditioning (HVAC) system 100, according to an embodiment of the present invention. The HVAC system 100 may be installed within a building, such as a building 128 (as shown in FIG. 1B) for an energy management of the building 128. In an embodiment of the present invention, the HVAC system 100 may be an Internet of Things (IoT) and an Artificial Intelligence (AI) based system. The HVAC system 100 may be designed to use specialized hardware to control a last mile of a steam, hot water, chilled water, and heated and/or cooled air flowing into the building 128, which may be used for heating and/or cooling the building 128. In an embodiment of the present invention, the steam, hot water, chilled water, and heated and/or cooled air may flow into the building 128 through one or more ducts having an air damper valve 708 (as shown in FIG. 7C).

The HVAC system 100 may comprise a plurality of external sensors 102*a*-102*m* (hereinafter referred to as the external sensors 102), a plurality of internal sensors 104*a*-104*n* (hereinafter referred to as the internal sensors 104), a plurality of Smart Metering Units (SMU) 106*a*-106*o* (hereinafter referred to as the SMU 106), a plurality of valve control boxes 108*a*-108*p* (hereinafter referred to as the control box 108), a Lobby Control Unit (LCU) 110, and a cloud server 112. Further, the external sensors 102, the internal sensors 104, the SMU 106, the valve control box 108, the LCU 110, and the cloud server 112 may be connected through a communication network 114, according to an embodiment of the present invention. In an embodiment of the present invention, the components of the HVAC system 100 may be connected through the communication network 114 by using a Building Management System (BMS) interface module 804 (as shown in FIG. 8B), according to an embodiment of the present invention.

According to embodiments of the present invention, the communication network 114 may be a Wireless Local Area Network (WLAN) of a premise of the building 128, such as, but not limited to, a house, an office, and so forth. Further, the communication network 114 may include a data network such as, but not limited to, the Internet, a Local Area Network (LAN), a Wide Area Network (WAN), a Metropolitan Area Network (MAN), and so forth. In some embodiments of the present invention, the communication network 114 may include a wireless network, such as, but not limited to, a cellular network and may employ various technologies including an Enhanced Data Rates for Global Evolution (EDGE), a General Packet Radio Service (GPRS), and so forth. In a preferred embodiment of the present invention, the communication network 114 may utilize a 900 Mega Hertz (MHz) mesh network within the building 128 allowing a wireless in-building communication between the components of the HVAC system 100. Further, the communication network 114 may be a self-healing network with a built-in route optimization, according to embodiments of the present invention. Embodiments of the present invention are intended to include or otherwise cover any type of the communication network 114, including known, related art, and/or later developed technologies.

The external sensors 102 may be sensors configured to sense data associated with one or more external variables associated with an external environment of the building 128, according to an embodiment of the present invention. The external sensors 102 may be installed at an exterior area of the building 128, according to an embodiment of the present invention. The external variables may be, but not limited to, a side of the building receiving a direct sunlight, a wind condition, an external temperature, and so forth. In an embodiment of the present invention, the SMU 106 may be capable of receiving the data representing the external variables that may be collected from a third-party service provider (not shown). The external variables received from the third party service provider may be, but not limited to, a current weather condition, a future weather forecast, a weather forecast for a next hour, next 3 hours, next 12 hours, and so forth. Embodiments of the present invention are intended to include or otherwise cover any type of the external variables. Further, the external sensors 102 may be, but not limited to, a temperature sensor, a humidity sensor, a barometric sensor, a dew point sensor, a wind speed sensor, a wind direction sensors, a sunlight sensor, a rain sensor, a fog sensor, a snow sensor, and so forth. Embodiments of the present invention are intended to include or otherwise cover any type of the external sensors 102, including known, related art, and/or later developed technologies.

The internal sensors 104 may be sensors provided to sense data associated with one or more internal variables from within the building 128, according to an embodiment of the present invention. The internal sensors 104 may be installed at an interior area of the building 128 such as, but not limited to, a door, a room, a window, a wall, a basement, a radiator, and so forth. Embodiments of the present invention are intended to include or otherwise cover any type of the interior area of the building 128 to install the internal sensors 104. The internal variables may be, but not limited to, a temperature, an occupancy in the room, an opened window, a humidity, an opened actuator valve, and so forth. Embodiments of the present invention are intended to include or otherwise cover any type of the internal variables. Further, the internal sensors 104 may be, but not limited to, a temperature sensor, a humidity sensor, a motion sensor, a window contact sensor, an actuator valve sensor, a boiler/chiller temperature sensor, a main heating and/or cooling on-off sensor, and so forth. Embodiments of the present invention are intended to include or otherwise cover any type of the internal sensors 104, including known, related art, and/or later developed technologies.

Figure 2A:
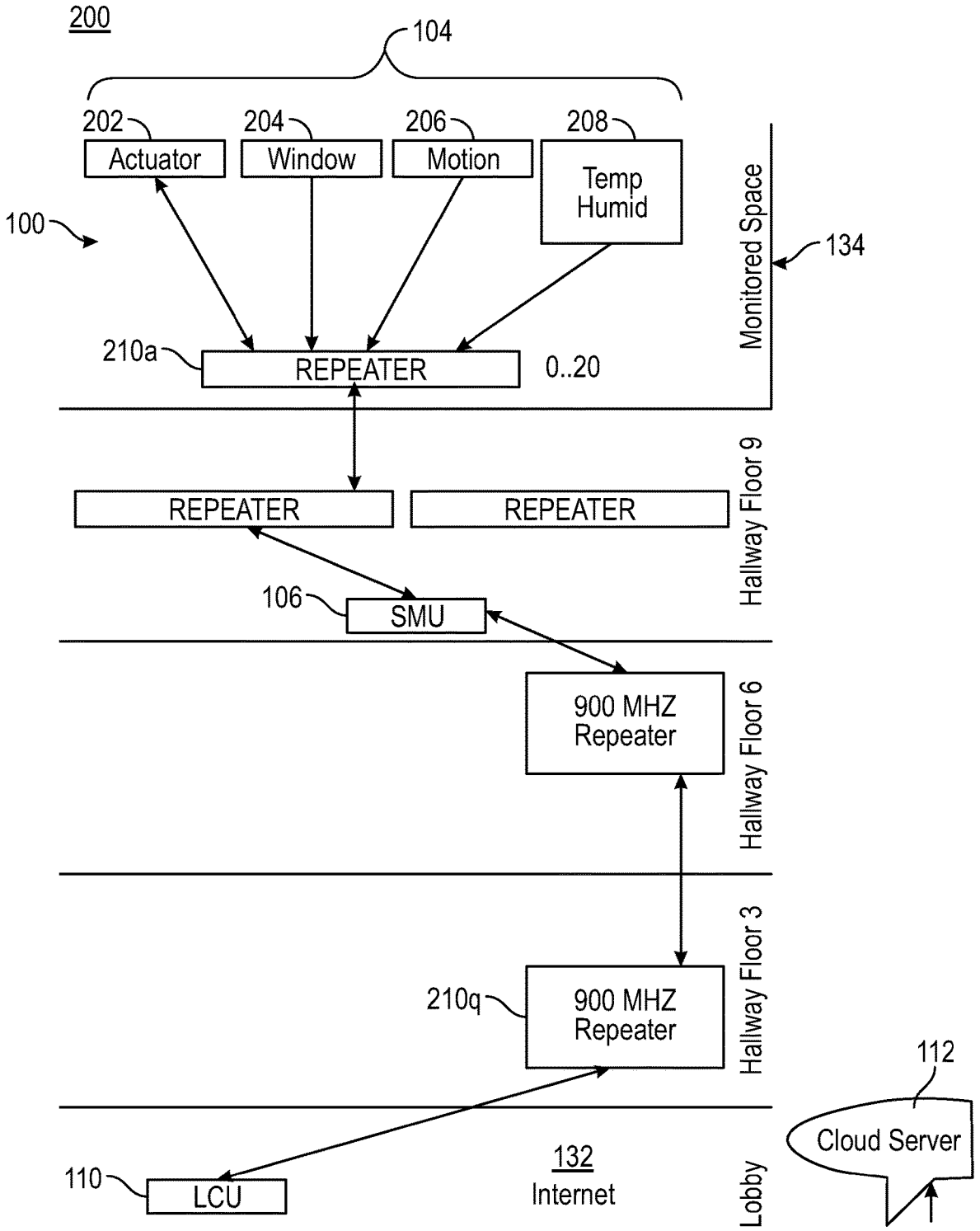
FIG. 2A illustrates an exemplary flow diagram of the HVAC system, according to an embodiment of the present invention.

The SMU 106 may be a processor that may be configured to process data associated with the HVAC system 100, according to embodiments of the present invention. Further, the SMU 106 may be configured to wirelessly interact with the LCU 110 over the communication network 114 through a plurality of repeaters 210*a*-210*q* (hereinafter referred to as the repeaters 210), as shown in FIG. 2A. Furthermore, the SMU 106 may act as a slave device for the LCU 110 that may act as a master device in the HVAC system 100 for transmitting data received from the SMU 106 to the cloud server 112, according to embodiments of the present invention. In another embodiment of the present invention, the LCU 110 may be configured for coordinating communication between the components of the HVAC system 100. The SMU 106 may be, but not limited to, a Programmable Logic Control unit (PLC), a microcontroller, a microprocessor, a computing device, a development board, and so forth. In a preferred embodiment of the present invention, the SMU 106 may be an A53 rock chip powered System on Module (SOM) that may be configured to run programs such as, but not limited to, a custom Linux BSP, a database, a custom Radio Frequency (RF) software, and so forth. The RF software may enable the SMU 106 to communicate with the external sensors 102, the internal sensors 104, the LCU 110, and/or any other SOM known to a person of ordinary skilled in the art. Further, the SMU 106 may be configured to utilize a 900 Mega Hertz (MHz) radio to communicate with other 900 MHz radios in an area such as, a hallway, of the building 128 by creating a self-healing mesh (i.e. SX), in an embodiment of the present invention. The self-healing mesh (i.e. SX) may be the communication network 114 configured to enable a wireless communication between the SMU 106 and the LCU 110 within the building 128, in an embodiment of the present invention.

Furthermore, the SMU 106 may be configured to operate at 250 Kilobits Per Second (Kbps), according to embodiments of the present invention. The SMU 106 may be addressed by a unique Media Access Control (MAC) address that may be a unique identifier assigned to the SMU 106 for use as a network address for communications within the communication network 114, in an embodiment of the present invention. Further, the SMU 106 may be connected to a memory board (not shown) and a communication module (not shown). The memory board may enable the SMU 106 to store the received data in real time, in an embodiment of the present invention. The memory board may further enable the SMU 106 to transmit the received data to the LCU 110 when requested by the LCU 110 by using the unique MAC address of the SMU 106, in another embodiment of the present invention. The communication module connected to the SMU 106 may comprise an Advanced Encryption Standard (AES) 256 bit encrypted 2.4 Giga Hertz (GHz) Zigbee radio to communicate with the external sensors 102, and the internal sensors 104, in an embodiment of the present invention. Further, the communication module may comprise a plurality of Red Green Blue (RGB) Light Emitting Diodes (LEDs) to indicate a status of the HVAC system 100. In an embodiment of the present invention, the SMU 106 may be configured to execute an Artificial Intelligence (AI) algorithm that may be stored at the memory board to execute one or more rules generated by a management platform 124 of the cloud server 112. In addition, the SMU 106 may be configured to execute an Artificial Intelligence (AI) algorithm to generate one or more signals for enabling the rules generated by the cloud server 112 to control one or more operations associated with the HVAC system 100, such as, but not limited to the actuator valve 302. Embodiments of the present invention are intended to include or otherwise cover any type of the SMU 106 including known, related art, and/or later developed technologies that may be capable of processing the received data. The working of the SMU 106 will be explained in detail in conjunction with FIG. 5.

The valve control box 108 may be an enclosure designed to hold a plurality of components such as, but not limited to, a battery 116, a communication module 118, a controller 120, and so forth. The valve control box 108 may be made up of a material such as, but not limited to, a metal, a hardened plastic, wood, and so forth. Embodiments of the present invention are intended to include or otherwise cover any type of the material for making the valve control box 108, including known, related art, and/or later developed technologies. Further, the valve control box 108 may be connected to an actuator motor 304 to control the operation of the actuator valve 302 (as shown in the FIG. 3), in an embodiment of the present invention.

The battery 116 may be configured to provide an electrical energy for a functioning of the components of the valve control box 108. The battery 116 may be, but not limited to, a Nickel Cadmium (NiCd) battery, a Nickel-Metal Hydride (NiMH) battery, a Lead Acid battery, a Lithium Ion battery, a Lithium Polymer battery, and so forth. Embodiments of the present invention are intended to include or otherwise cover any type of the battery 116 including known, related art, and/or later developed technologies.

Further, the communication module 118 may be provided to receive and/or transmit one or more signals associated within the HVAC system 100. Furthermore, the communication module 118 may be configured to establish a communication between the SMU 106 and the valve control box 108, according to an embodiment of the present invention. The communication module 118 may be, but not limited to, a Bluetooth®, a ZigBee, a z-wave, and so forth. In a preferred embodiment of the present invention, the communication module 118 may be a radio. Embodiments of the present invention are intended to include or otherwise cover any type of the communication module 118 including known, related art, and/or later developed technologies.

The controller 120 may be configured to receive the one or more signals generated by the SMU 106 to control the operation of the components of the HVAC system 100 such as, but not limited to, the actuator valve 302, in an embodiment of the present invention. Further, the controller 120 may be configured to execute one or more functions associated with the HVAC system 100, according to an embodiment of the present invention. The controller 120 may be, but not limited to, a Programmable Logic Control unit (PLC), a microcontroller, a microprocessor, a computing device, a development board, and so forth. Embodiments of the present invention are intended to include or otherwise cover any type of the controller 120 including known, related art, and/or later developed technologies that may be capable of processing the received data.

The LCU 110 may be a master building coordinator that may be configured to communicate with each SMU 106 in the building 128 over the communication network 114, according to embodiments of the present invention. The LCU 110 may be an A53 rock chip powered System on Module (SOM) that may be configured to run programs such as, but not limited to, a custom Linux BSP, a database, and a custom Radio Frequency (RF) software. The RF software may enable the LCU 110 to communicate with each of the SMU 106 in the building 128. Further, the LCU 110 may be configured to utilize a 900 Mega Hertz (MHz) radio to communicate with other 900 MHz radios in an area such as, a hallway of the building, by creating a self-healing mesh (i.e. SX), in an embodiment of the present invention. Furthermore, the LCU 110 may be configured to operate at 250 Kilobits Per Second (Kbps), according to embodiments of the present invention.

The LCU 110 further comprises a memory board (not shown) to store and forward data associated with the HVAC system 100. The memory board of the LCU 110 may be having a memory size of 256 Giga Bytes (GB), according to an embodiment of the present invention. Further, the LCU 110 may be configured to run a loop to generate a status request signal to the SMU 106. The generated status request signal received by the SMU 106 may enable the SMU 106 to transmit the status of the HVAC system 100 to the LCU 110. The received status may be collected and stored in the memory board of the LCU 110, in an embodiment of the present invention.

Furthermore, the LCU 110 may be configured to check if a firmware of the SMU 106 is up to date or not, in an embodiment of the present invention. In another embodiment of the present invention, the LCU 110 may be configured to disseminate a sensor firmware to the SMU 106 to update the external sensors 102 and the internal sensors 104. Further, the LCU 110 may be configured to transmit the data received from the SMU 106 to the cloud server 112 through a communication technique or a network such as, but not limited to, wireless communication technique or any other such technique known to a person skilled in the art. In an embodiment of the present invention, the communication between the LCU 110 and the cloud server 112 may be through a Message Queuing Telemetry Transport (MQTT) and a restful web services over a Hypertext Transfer Protocol Secure (HTTPS) or Transport Layer Security (TLS), according to an embodiment of the present invention.

The cloud server 112 may be a virtual server running in a cloud computing environment connected to the LCU 110 through the communication technique or a network such as, but not limited to, wireless communication technique or any other such technique known to a person skilled in the art. The cloud server 112 may be, but not limited to, an Amazon Web Services (AWS) cloud that may comprise one or more servers located at multiple locations. The cloud server 112 may be an intelligent cloud server that may route requests from the building 128 to a nearest physical location at an optimized speed. Further, the cloud server 112 may be automatically backed up and become redundant, in an embodiment of the present invention. Furthermore, the cloud server 112 may be configured to generate one or more rules to learn the building's performance and use internal and/or external variables to daily improve the optimization of the usage of energy in the building 128. The cloud server 112 may comprise a database 122 and the management platform 124, according to an embodiment of the present invention. The database 122 may be configured to store data associated with the HVAC system 100, according to embodiments of the present invention. The database 122 may be, but not limited to, a centralized database, a distributed database, a personal database, an end-user database, a commercial database, a Structured Query Language (SQL) database, a Non-SQL database, an operational database, a relational database, a cloud database, an object-oriented database, a graph database, and so forth. Embodiments of the present invention are intended to include or otherwise cover any type of the database 122 including known, related art, and/or later developed technologies that may be capable of data storage and retrieval.

The management platform 124 of the cloud server 112 may be one or more computer readable instructions that may be stored onto the database 122. The management platform 124 may be configured to control the operations of the HVAC system 100 through the SMU 106 and the LCU 110. Further, the management platform 124 may be configured to generate one or more rules to learn a performance of the building 128 and analyze one or more data to daily improve an optimization of a usage of an energy in the building 128. Further, the management platform 124 may comprise a self-learning capability that may enable the management platform 124 to get smarter as more variations of data is collected and analyzed in the HVAC system 100. The working of the management platform 124 will be explained in detail in conjunction with FIG. 3.

FIG. 1B illustrates an exemplary installation 126 of the HVAC system 100 in the building 128, according to an embodiment of the present invention. The HVAC system 100 may comprise one SMU 106 installed on each of a plurality of floors 130*a*-130*r* (hereinafter referred to as the floor 130) of the building 128. Further, the LCU 110 may be installed in a lobby 132 of the building 128. Further, each of the SMU 106 and the LCU 110 may be connected through the communication network 114 forming the self-healing mesh (i.e. SX), as discussed above. The communication network 114 may be configured to provide a route optimization for faster communication between the SMU 106 and the LCU 110, according to an embodiment of the present invention. Further, the SMU 106 may be configured to collect sensed data from the external sensors 102, the internal sensors 104, the third-party service provider, or a combination thereof, according to an embodiment of the present invention. Furthermore, the SMU 106 may be configured to transmit the sensed data to the LCU 110 installed in the lobby 132 of the building 128. In an embodiment of the present invention, the SMU 106 may transmit the sensed data to the LCU 110 when requested by the LCU 110. Further, the LCU 110 may be configured to collect the sensed data from the SMU 106 and transmit the sensed data to the cloud server 112 over the communication technique or a network such as, but not limited to, wireless communication technique or any other such technique known to a person skilled in the art. The management platform 124 of the cloud server 112 may then be configured to process and analyze the received sensed data using an Artificial Intelligence (AI) algorithm. Further, the management platform 124 may be configured to generate rules based on the analyzed sensed data for functioning of the HVAC system 100 in the building 128. Furthermore, the management platform 124 may be configured to optimize a how, when, and for how long energy (heating and/or cooling) is to be used for lowering energy costs and creating a comfortable, controllable zone within the building 128, according to embodiments of the present invention.

Figure 1C:
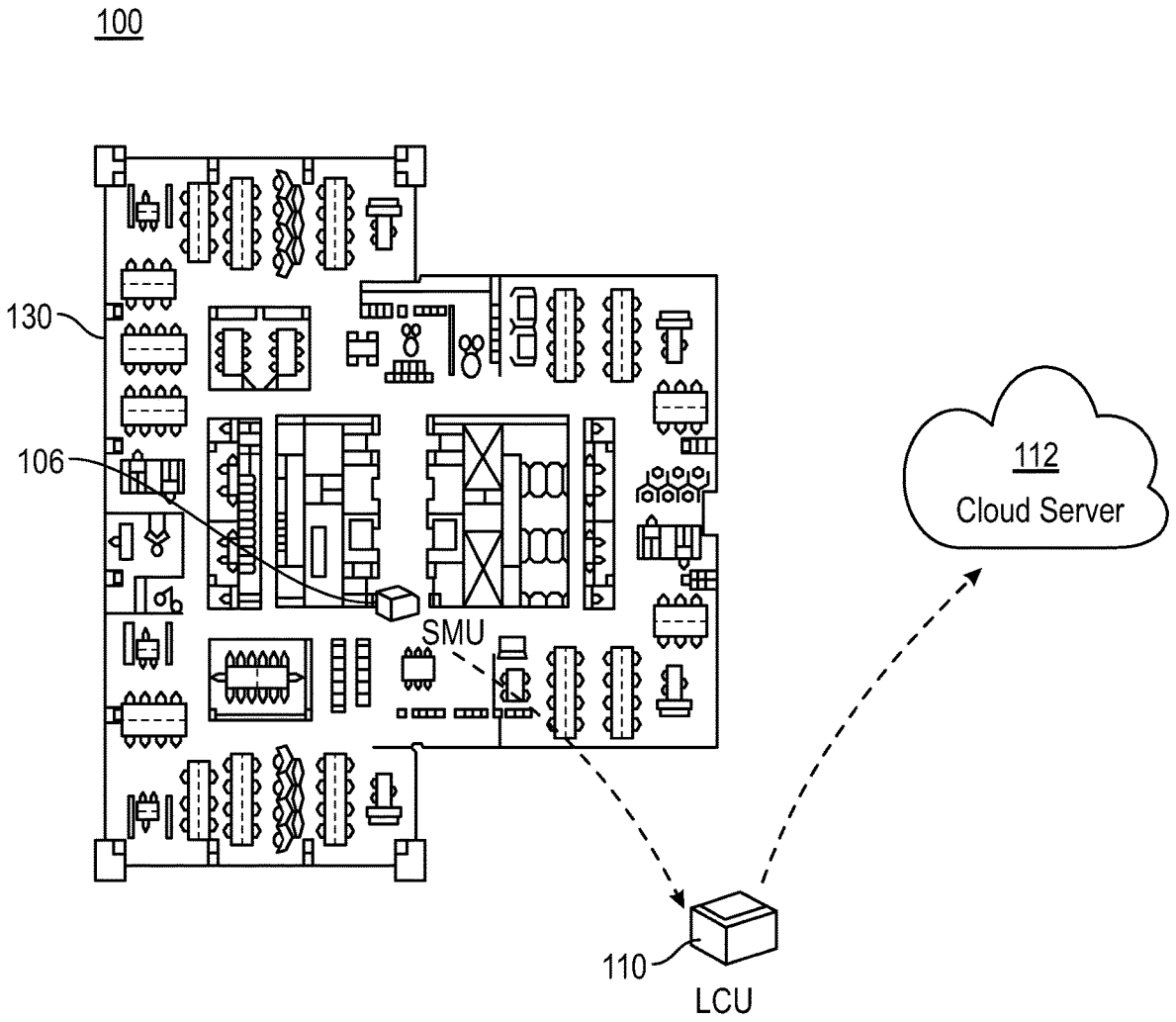
FIG. 1C illustrates the HVAC system installed on a floor of the building, according to an embodiment of the present invention.

FIG. 1C illustrates an exemplary scenario of the HVAC system 100 installed on the floor 130 of the building 128, according to an embodiment of the present invention. The SMU 106 may be configured to transmit the sensed data received for the external sensors 102, the internal sensors 104 and the third-party service provider to the LCU 110 through the communication network 114. The LCU 110 may then be configured to transmit the received sensed data to the cloud server 112 for analysis and optimization by the management platform 124. The management platform 124 may be configured to control operations of the HVAC system 100 through the LCU 110 and the SMU 106. Further, the management platform 124 may be configured to determine a performance of the building 128 and analyze the sensed data to daily improve the optimization of the usage of the energy in the building 128.

Figure 1D:
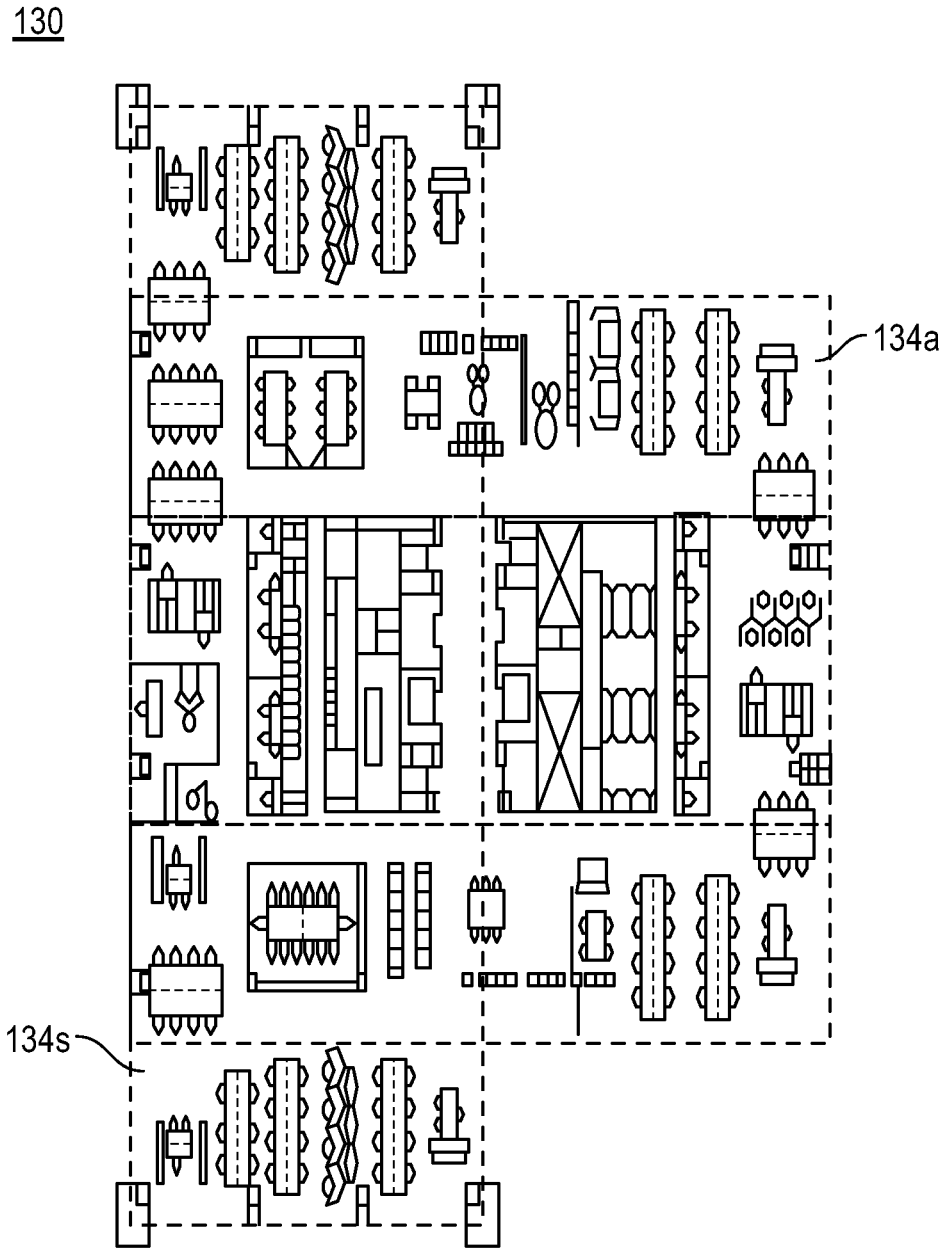
FIG. 1D illustrates an exemplary plan of the floor of the building, according to an embodiment of the present invention.

FIG. 1D illustrates an exemplary floor 130 of the building 128, according to an embodiment of the present invention. The floor 130 may be divided into a plurality of virtual HVAC zones 134*a*-134*s* (hereinafter referred to as the virtual HVAC zones 134). According to an exemplary scenario, the HVAC system 100 may predict what side the sun is facing a building and use less heat on that side and warm the building where the wind makes it cool. The HVAC system 100 may elevate a number of zones from only a few zones per building 128 i.e. every 10 floors of a 60-story building as a zone, to thousands of zones, thereby creating the virtual HVAC zones 134. In an embodiment of the present invention, the plurality of the virtual HVAC zones 134 may be sub-metered to measure obtained reduction of the energy used in the building 128.

FIG. 2A illustrates an exemplary flow diagram 200 of the HVAC system 100, according to an embodiment of the present invention. The HVAC system 100 may be configured to control a heating and/or a cooling of a monitored space such as, the virtual HVAC zone 134 of the floor 130 in the building 128. The "monitored space" may be created as the virtual HVAC zone 134 by controlling the temperature of the virtual HVAC zone 134. The virtual HVAC zone 134 may be a room of the floor 130, which may have a window and a radiator. The virtual HVAC zone 134 may be monitored by using the internal sensors 104. The internal sensors 104 may be, but not limited to, an actuator valve sensor 202, a window contact sensor 204, a motion sensor 206, and a temperature/humidity sensor 208. For example, the window contact sensor 204 may determine whether the window is open or close. Further, the internal sensors 104 may be configured to communicate the sensed data to the SMU 106 through the repeaters 210. In an embodiment of the present invention, the repeaters 210 may update the actuator valve 302 on receiving the sensed data and perform the opening or closing of the actuator valve 302. In an embodiment of the present invention, the repeaters 210 may be capable of handling approximately 20 internal sensors 104. In case, a number of the internal sensors 104 installed in the virtual HVAC zone 134 is greater than 20, then a second level of repeaters 210 may be installed to transmit the sensed data from the internal sensors 104 to the SMU 106. As shown in the FIG. 2A, two repeaters are installed on a hallway of a ninth floor of the building to transmit the data from the internal sensors 104 to the SMU 106. The SMU 106 may be configured to turn on or turn off the heating and/or the cooling in the virtual HVAC zone 134 based on the rules generated by the cloud server 112. For example, in case, the SMU 106 determines that the window is open based on the received sensed data, then the SMU 106 may decide to shut off the actuated steam, hot water, chilled water and ducted air valves/dampers in the virtual HVAC zone 134. The rules generated by the cloud server 112 may be based on the sensed data of the internal sensors 104, according to embodiments of the present invention.

Further, the sensed data is transmitted from the SMU 106 to the LCU 110 that is installed at a lobby 132 of the building for further processing through the repeaters 210 over the communication network 114 when the LCU 110 generates a request using a MAC address of the SMU 106. In case, if a distance of the SMU 106 to the LCU 110 is greater than a maximum range of a repeater 210, then a second level of the repeaters 210 may be used to transmit the sensed data from the SMU 106 to the LCU 110. As shown in the FIG. 2A, one 900 MHZ repeater is installed in a hallway of a sixth floor, and one 900 MHZ repeater is installed in a hallway of a third floor of the building to transmit the sensed data from the SMU 106 to the LCU 110. Further, the LCU 110 may be configured to transmit the data to the cloud server 112 through the communication technique or a network such as, but not limited to, wireless communication technique or any other such technique known to a person skilled in the art, for further analysis by the management platform 124 to determine if the optimization helped and/or hurt an efficiency of the HVAC system 100.

Figure 2B:
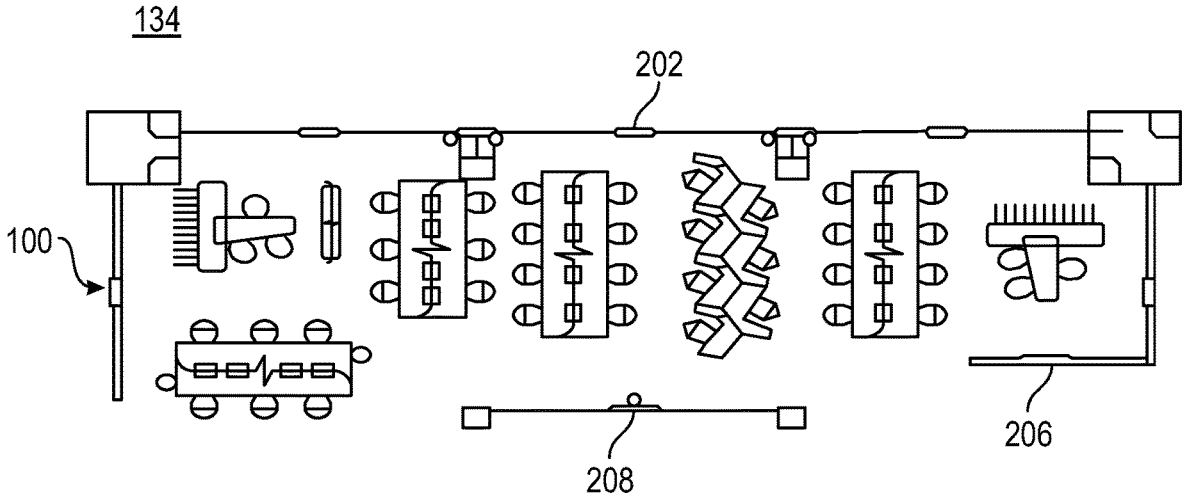
FIG. 2B illustrates a block diagram of a virtual HVAC zone having the HVAC system, according to an embodiment of the present invention.
Figure 3:
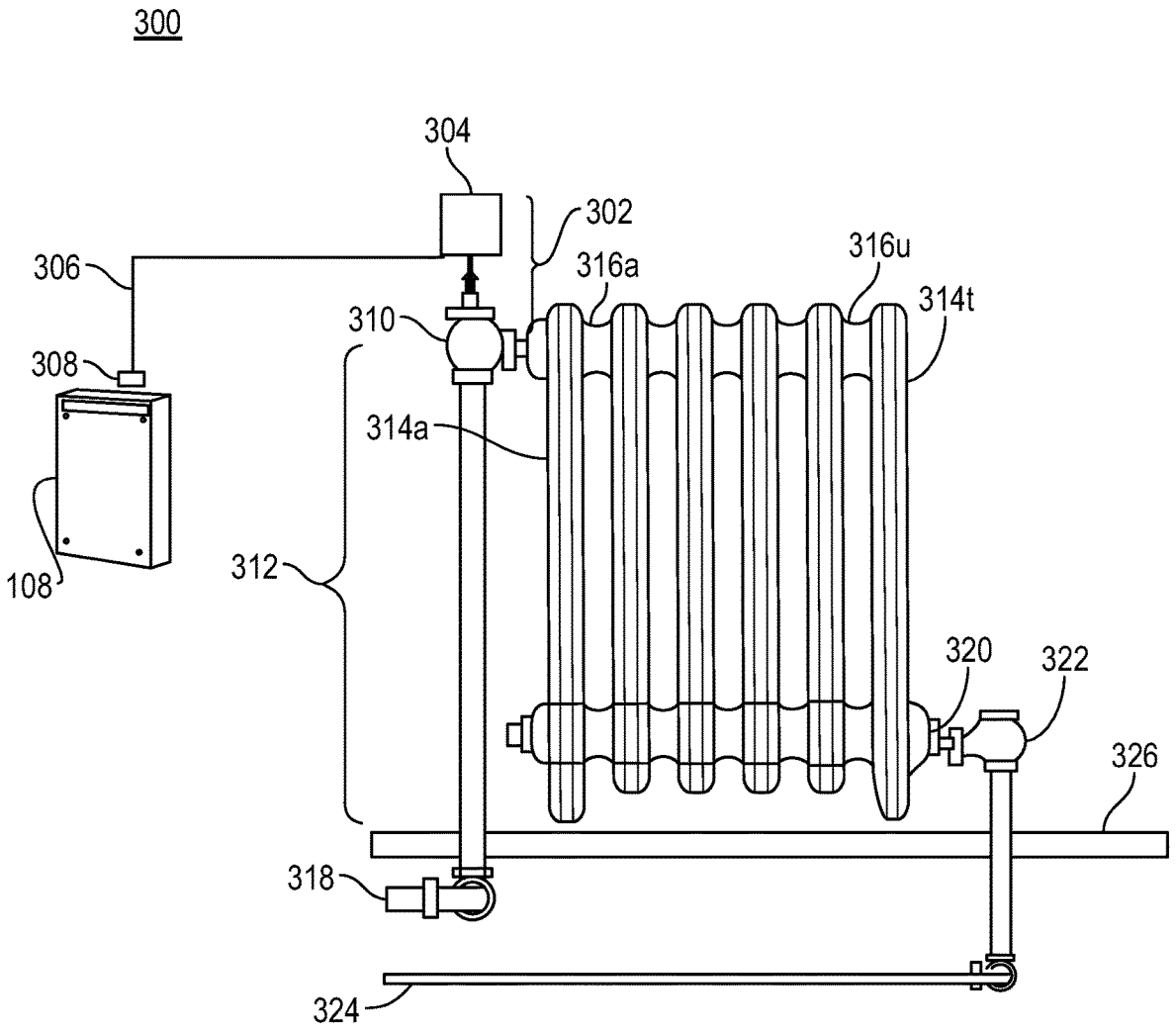
FIG. 3 illustrates an installation of a valve control box in the HVAC system, according to an embodiment of the present invention.

FIG. 2B illustrates a block diagram of the virtual HVAC zone 134 having the HVAC system 100, according to an embodiment of the present invention. The virtual HVAC zone 134 may comprise the actuator valve sensor 202, the motion sensor 206, and the temperature/humidity sensor 208. The HVAC system 100 may be configured to utilize the actuator valve sensor 202 to determine if one or more actuator valves 302*a*-302*v* (hereinafter referred to as the actuator valve 302) (as shown in FIG. 3) is turned on and/or turned off the heating and/or the cooling in the virtual HVAC zones 134. Further, the temperature/humidity sensor 208 may be provided to sense a temperature and/or a humidity inside the virtual HVAC zone 134. The motion sensor 206 may be configured to determine an occupancy status in the virtual HVAC zone 134. Further, the sensed data from the motion sensor 206, and the temperature/humidity sensor 208 may be used by the HVAC system 100 to generate a predictive schedule based on the occupancy status of the virtual HVAC zone 134, thereby preventing either the heating and/or the cooling of the virtual HVAC zone 134 too early and/or too late.

Figure 2C:
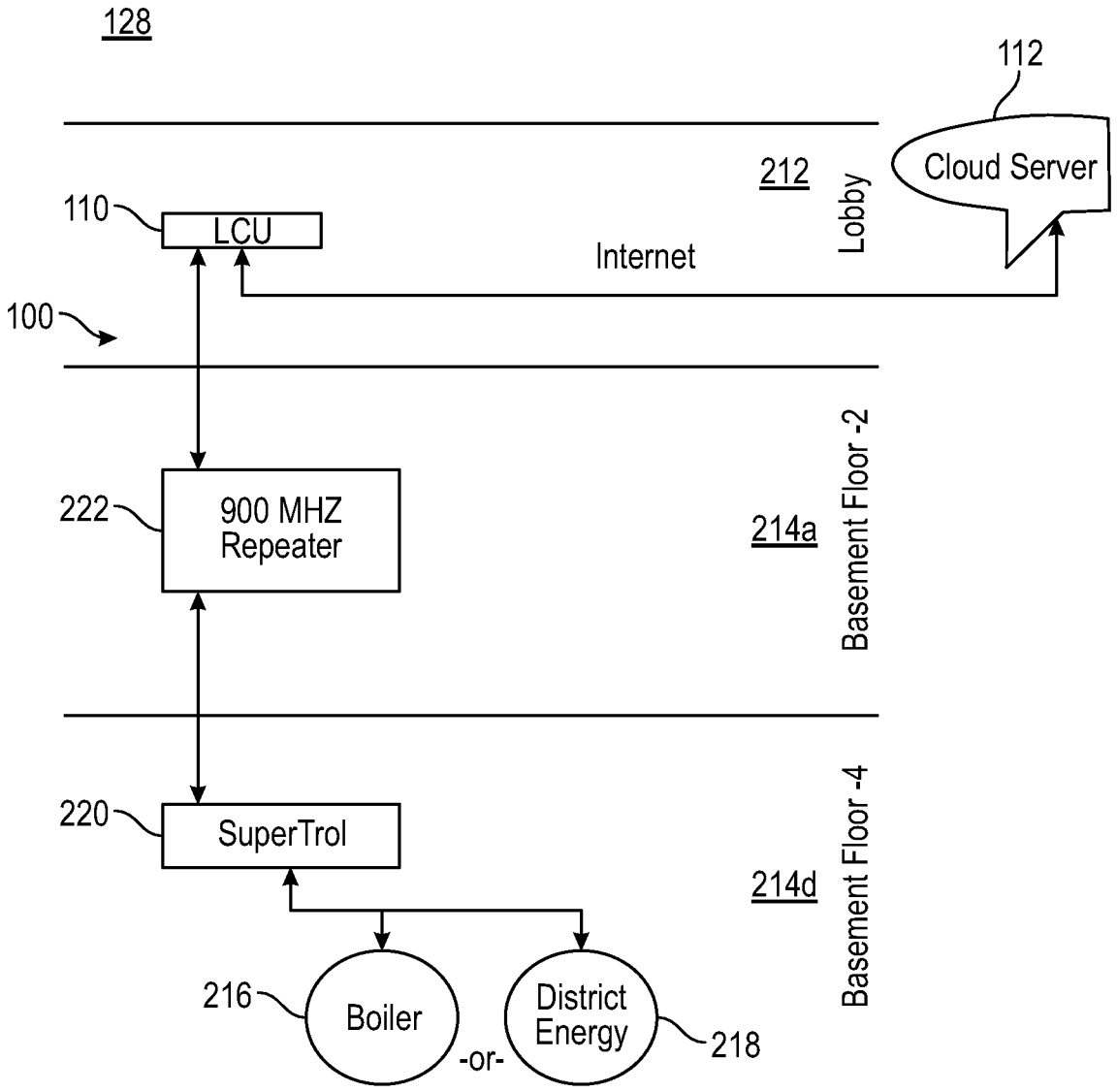
FIG. 2C illustrates an exemplary flow diagram of the HVAC system installed in the building, according to another embodiment of the present invention.

FIG. 2C illustrates an exemplary flow diagram of the HVAC system 100 installed in the building 128, according to another embodiment of the present invention. The building 128 may comprise a lobby 212, a plurality of basements 214*a*-214*d* (hereinafter referred to as basement 214). The basement 214 may serve as a service entrance for a district energy source, such as a Con-Edison, a source of a steam (or hot water) produced by self-generation. In an embodiment of the present invention, a boiler 216, and a district energy setup 218 may be installed in the basement 214*d* that may be further connected to a device 220, such as a SuperTrol® device. The device 220 may be configured to determine a steam usage of the building 128, in an embodiment of the present invention. Further, a boiler/chiller sensor 600 (as shown in the FIG. 6D) may be installed to detect if the boiler 216 installed in the basement 214*d* is on or off. In an embodiment of the present invention, the boiler/chiller sensor 600 may be configured to transmit the sensed data of the boiler 216 to the LCU 110 through a 900 Mega Hertz (MHz) repeater 222. In an embodiment of the present invention, the repeater 222 may be installed at the basement 214*a*. Further, the LCU 110 may transmit the received sensed data to the cloud server 112 through a communication technique or a network such as, but not limited to, wireless communication technique or any other such technique known to a person skilled in the art. The management platform 124 may then be configured to analyze the received sensed data. In case, the management platform 124 determines that the boiler 216 is off, i.e., no steam is being provided. Further, the management platform 124 may be configured to generate a rule to deactivate the actuator valve 302 of one or more radiators 312*a*-312*v* (hereinafter referred to as the radiator 312) (as shown in FIG. 3).

FIG. 3 illustrates an installation 300 of the valve control box 108 in the HVAC system 100, according to an embodiment of the present invention. The valve control box 108 may be connected to the actuator valve 302 through an actuator motor 304 of the actuator valve 302. Further, the actuator motor 304 may be connected to the valve control box 108 through a wire 306, and a connector 308. The actuator motor 304 may be provided to convert an electrical energy into a torque that may be used to control an opening and/or closing of a radiator valve 310 connected to a top end of the radiator 312 of the HVAC system 100 installed within the virtual HVAC zone 134, according to an embodiment of the present invention. The actuator motor 304 may be, but not limited to, a linear actuator motor, a push pull actuator motor, a rotary actuator motor, and so forth. Embodiments of the present invention are intended to include or otherwise cover any type of the actuator motor 304, including known, related art, and/or later developed technologies. According to an embodiment of the present invention, the radiator valve 310 may be provided to remotely turn on or off the radiator 312 in the building 128. The radiator 312 may be tied to the SMU 106 via Radio Frequency (RF) or any other such communication network known to a person skilled in the art, in an embodiment of the present invention.

The wire 306 for connecting the valve control box 108 to the actuator motor 304 may be, but not limited to, a coaxial cable, a direct buried cable, a filled cable, a non-metallic sheathed cable, a metallic sheathed cable, and so forth. Embodiments of the present invention are intended to include or otherwise cover any type of the wire 306, including known, related art, and/or later developed technologies. Further, the connector 308 may be a mechanical connector that may be used to connect the wire 306 to the valve control box 108, according to embodiments of the present invention. The connector 308 may be made up of a material such as, but not limited to, a metal, a hardened plastic, and so forth. Embodiments of the present invention are intended to include or otherwise cover any type of the material for the connector 308, including known, related art, and/or later developed technologies.

The radiator valve 310 may be a part of the actuator valve 302 that may be used to open and/or close the heating and/or cooling of the virtual HVAC zones 134 through the radiator 312 based on the rules generated by the management platform 124, according to embodiments of the present invention. Further, the radiator valve 310 may be a battery-operated valve having a wireless communication capability controlled through the actuator motor 304, according to an embodiment of the present invention. The radiator valve 310 may be, but not limited to, a pneumatic valve, a hydraulic valve, an electric valve, a manual valve, and so forth. Embodiments of the present invention are intended to include or otherwise cover any type of the radiator valve 310, including known, related art, and/or later developed technologies.

The radiator 312 may be a heat exchanger that may be used to transfer a thermal energy for the cooling and/or the heating of the virtual HVAC zones 134, according to embodiments of the present invention. Further, the radiator 312 may comprise a plurality of radiator pipes 314*a*-314*t* (hereinafter referred to as the radiator pipes 314) that may be arranged in a parallel configuration connected to each other. The radiator pipes 314 may be made up of a copper material, according to an embodiment of the present invention. The parallel configuration of the radiator pipes 314 may further form a plurality of sections 316*a*-316*u* (hereinafter referred to as the sections 316). Further, the sections 316 may be made up of an aluminum material that may increase a surface area of the radiator 312, according to an embodiment of the present invention.

Further, a steam may be supplied through a steam supply nozzle 318 to the radiator valve 310. The radiator valve 310 may be controlled by the actuator motor 304 to supply a heat and/or a cold to the virtual HVAC zones 134. Further, an eccentric bush 320 may be attached to a bottom end of the radiator 312 and a steam/condensate trap 322 to trap water in the radiator 312. The water may be flowed through the radiator pipes 314 and the sections 316 for cooling and/or heating the virtual HVAC zones 134. Further, an excess water may flow back from a return line 324 installed in a floor pipe 326 of the virtual HVAC zones 134, according to an embodiment of the present invention. In an embodiment of the present invention, the HVAC system 100 may use the internal sensors 102 to monitor the steam/condensate trap 322 wirelessly in the building 128. In an embodiment of the present invention, the HVAC system 100 may use battery less energy harvesting internal sensors 102 using ultra-low power radios to monitor the steam/condensate trap 322 in the building 128. In an embodiment of the present invention, the steam/condensate trap 322 in the building 128 may be monitored over the communication network such as a wireless installed network. The internal sensors 102 may be used to detect a vibration and a temperature in the steam/condensate trap 322. The detected vibration and the temperature may then be used to determine a baseline temperature and a vibration pattern to monitor an abnormality in the steam/condensate trap 322. The abnormality in the steam/condensate trap 322, if not detected, may waste tremendous amount of the energy in the HVAC system 100.

Figure 4:
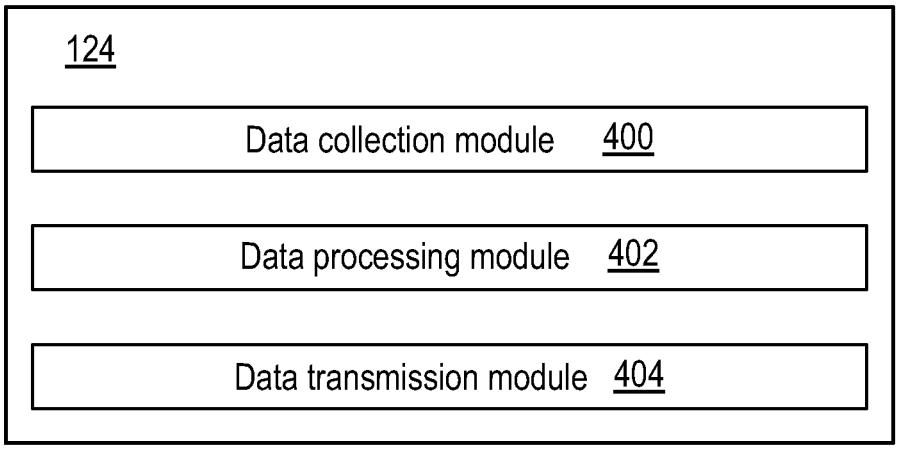
FIG. 4 illustrates components of a management platform of a cloud server, according to an embodiment of the present invention.

FIG. 4 illustrates components of the management platform 124 of the cloud server 112, according to an embodiment of the present invention. The management platform 124 may comprise, but not limited to, a data collection module 400, a data processing module 402, and a data transmission module 404.

The data collection module 400 may be configured to receive the sensed data accumulated at the LCU 110 installed within the building 128, according to an embodiment of the present invention. As discussed, the sensed data may be received by the LCU 110 from the SMU 106. The data collection module 400 may be further configured to store the received sensed data onto the database 122, in an embodiment of the present invention. Further, the data collection module 400 may be configured to transmit the sensed data to the data processing module 402, in an embodiment of the present invention.

The data processing module 402 may be configured to access the sensed data stored onto the database 122 to process the sensed data, in an embodiment of the present invention. In another embodiment of the present invention, the data processing module 402 may be configured to receive the sensed data from the data collection module 400 to process the sensed data.

Further, the data processing module 402 may be configured to analyze the processed sensed data using an Artificial Intelligence (AI) algorithm. The AI algorithm may be, but not limited to, a Naive Bayes algorithm, a Decision Tree algorithm, a Random Forest algorithm, a Support Vector Machine algorithm, a K Nearest Neighbor algorithm, a Linear regression algorithm, a Lasso Regression algorithm, a Logistic Regression algorithm, and so forth. Embodiments of the present invention are intended to include or otherwise cover any type of the AI algorithm, including known, related art, and/or later developed technologies.

Further, the data processing module 402 may be configured to generate one or more rules based on the analyzed sensed data, in an embodiment of the present invention. The generated rules may be used to control an operation of the HVAC system 100 installed within the building 128. In an exemplary scenario, the data processing module 402 may be configured to generate a first rule signal based on the sensed data from the window contact sensor 204 (as shown in the FIG. 2A), such that the first rule statement defines an action to be taken by the SMU 106, if one or more windows of the virtual HVAC zones 134 is opened. The action may be closing the actuator valve 302 to turn off the heating and/or cooling of the virtual HVAC zone 134. In another exemplary scenario, the data processing module 402 may be configured to determine an occupancy status of the virtual HVAC zone 134 based on the sensed data from the motion sensors 206 (as shown in the FIG. 2A) installed in the virtual HVAC zone 134. The data processing module 402 may be configured to predict an occupied time of the virtual HVAC zone 134 based on a historic data of the motion sensor 206 by using the AI algorithm, in an embodiment of the present invention. In another embodiment of the present invention, the data processing module 402 may be configured to predict a vacant time of the virtual HVAC zone 134 using the AI algorithm.

In an embodiment of the present invention, the data processing module 402 may be further configured to generate a second rule signal based on the prediction of the vacant virtual HVAC zones 134. The second rule signal may comprise a closing time for closing the actuator valve 302 of the virtual HVAC zones 134 to turn off the heating and/or cooling in the virtual HVAC zones 134. The closing time may be equal to a predefined time after the vacant virtual HVAC zones 134 are detected, according to an embodiment of the present invention. Further, the data processing module 402 may be configured to generate a third rule signal based on the prediction of the occupied virtual HVAC zones 134. The third rule signal may comprise an opening time for opening the actuator valve 302 of the virtual HVAC zones 134 to turn on the heating and/or cooling in the virtual HVAC zones 134. The opening time may be equal to the predefined time after the occupied virtual HVAC zones 134 are detected, according to an embodiment of the present invention. According to embodiments of the present invention, the predefined time may be in a range of 15 minutes to 30 minutes.

Further, the data processing module 402 may be configured to predict a temperature raise time based on the sensed data using the AI algorithm. The temperature raise time may be a time duration that the radiator 312 of the HVAC system 100 may require to raise the temperature of the virtual HVAC zones 134 to 1 degree. In yet another embodiment of the present invention, the data processing module 402 may be configured to predict a temperature fall time based on the sensed data using the AI algorithm. The temperature fall time may be a time duration that the radiator 312 of the HVAC system 100 may require to decrease the temperature of the virtual HVAC zones 134 to 1 degree. In yet another embodiment of the present invention, the data processing module 402 may be configured to predict a basement actuator activation time of the actuator valve 302 of the radiator 312 installed in the basement 214 of the building 128 (as shown in the FIG. 2C) based on the sensed data from the boiler on/off sensor and the device 220 installed in the basement 214 using the AI algorithm.

Further, the data processing module 402 may be configured to transmit the generated one or more rules such as, the first rule signal, the second rule signal, the third rule signal, the temperature raise time, the temperature fall time, and the basement actuator activation time to the data transmission module 404, according to an embodiment of the present invention.

The data transmission module 404 may be configured to transmit the one or more received rules such as, the first rule signal, the second rule signal, the third rule signal, the temperature raise time, the temperature fall time, and the basement actuator activation time to the LCU 110 through the communication technique or a network such as, but not limited to, wireless communication technique or any other such technique known to a person skilled in the art. Further, the LCU 110 may be configured to transmit the received rules to the SMU 106 over the communication network 114, according to an embodiment of the present invention.

Figure 5:
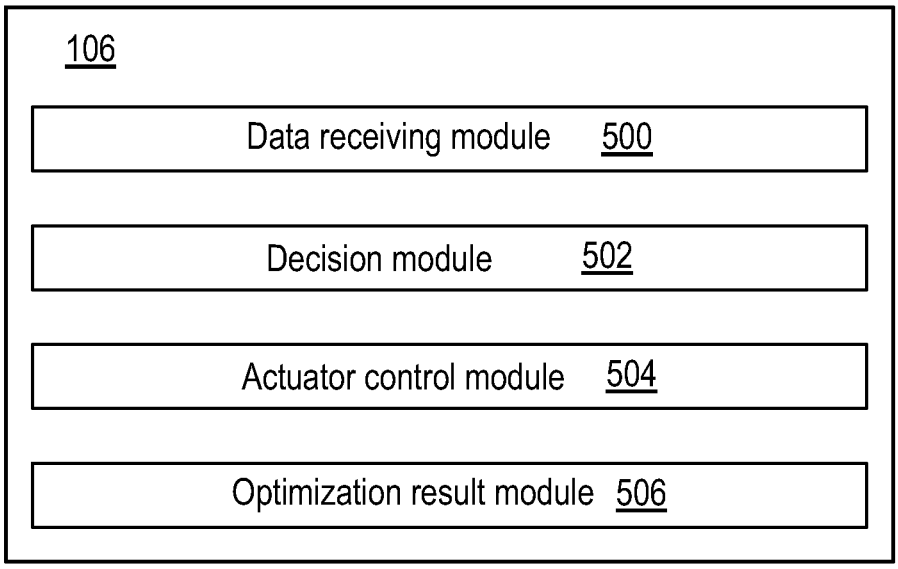
FIG. 5 illustrates components of a Smart Metering Unit (SMU), according to an embodiment of the present invention.

FIG. 5 illustrates components of the SMU 106, according to an embodiment of the present invention. The SMU 106 may comprise, but not limited to, a data receiving module 500, a decision module 502, an actuator control module 504, and an optimization result module 506.

The data receiving module 500 may be configured to receive the one or more rules such as, the first rule signal, the second rule signal, the third rule signal, the temperature raise time, the temperature fall time, and the basement actuator activation time from the management platform 124, in an embodiment of the present invention. Further, the data receiving module 500 may be configured to store the received one or more rules, such as, the first rule signal, the second rule signal, the third rule signal, the temperature raise time, the temperature fall time, and the basement actuator activation time onto the memory board (not shown) of the SMU 106, according to an embodiment of the present invention.

The decision module 502 may be configured to access the first rule signal, the second rule signal, the third rule signal, the temperature raise time, the temperature fall time, and the basement actuator activation time stored onto the memory board of the SMU 106 to determine actions to be taken using an Artificial Intelligence (AI) algorithm. The AI algorithm may be for example, but not limited to, a Naive Bayes algorithm, a Decision Tree algorithm, a Random Forest algorithm, a Support Vector Machine algorithm, a K Nearest Neighbor algorithm, a Linear regression algorithm, a Lasso Regression algorithm, a Logistic Regression algorithm, and so forth. Embodiments of the present invention are intended to include or otherwise cover any of the AI algorithm, including known, related art, and/or later developed technologies. In another embodiment of the present invention, the decision module 502 may be configured to analyze the sensed data in case any change in the sensed data is detected or not, for example, from the window contact sensor 204, and further to determine the actions to be performed based on learning patterns of the AI algorithm. In an exemplary scenario, if the data processing module 402 determines that the window of the virtual HVAC zone 134 is opened, then the decision module 502 may be configured to generate an actuator deactivation signal based on the first rule signal. Further, the decision module 502 may be configured to transmit the generated actuator deactivation signal to the actuator control module 504, in an embodiment of the present invention.

In another exemplary scenario, if the decision module 502 determines that a scheduled off time of the virtual HVAC zones 134 is 15 minutes away and a temperature change request is received, then based on the rules generated by the management platform 124, the decision module 502 may be configured to ignore the temperature change request. In yet another exemplary scenario, if the decision module 502 determines that the scheduled start time of the virtual HVAC zones 134 is "X", then the decision module 502 may be configured to generate an actuator activation signal that may enable the actuator valve 302 to adjust the temperature in the virtual HVAC zones 134 according to the temperature raise time and the temperature fall time received from the management platform 124 such that the temperature in the virtual HVAC zones 134 reach a final set temperature 15 minutes after the "X". The final set temperature may be a comfortable temperature required in the virtual HVAC zones 134, in an embodiment of the present invention. In another exemplary scenario, if the decision module 502 determines that the humidity in the virtual HVAC zones 134 is low based on the sensed data from the temperature/humidity sensor 208, then the decision module 502 may be configured to lower a call temperature of the virtual HVAC zones 134 to 1 degree. The call temperature of the virtual HVAC zones 134 may be a comfortable temperature required in the virtual HVAC zones 134, according to embodiments of the present invention.

In yet another exemplary scenario, if the decision module 502 determines that the temperature inside the virtual HVAC zones 134 is equal to the call temperature of the virtual HVAC zones 134, then the decision module 502 may be configured to generate the actuator deactivation signal to turn off the cooling and/or heating of the virtual HVAC zones 134. Further, if the decision module 502 determines that the temperature inside the virtual HVAC zones 134 is less than or greater than the call temperature of the virtual HVAC zones 134 by 2 degree, then the decision module 502 may be configured to generate the actuator activation signal to turn on the cooling and/or heating of the virtual HVAC zones 134 according to the temperature raise time received from the management platform 124. In yet another embodiment of the present invention, the decision module 502 may be configured to generate the actuator deactivation signal based on the second rule signal at the predefined time that may be extracted from a real-time watch (not shown) of the SMU 106. In yet another embodiment of the present invention, the decision module 502 may be configured to generate the actuator activation signal based on the third rule signal at the predefined time that may be extracted from the real-time watch of the SMU 106. Further, the decision module 502 may be configured to transmit the generated actuator activation signal and the actuator deactivation signal to the actuator control module 504, according to embodiments of the present invention.

The actuator control module 504 may be configured to receive the generated actuator activation signal and the generated actuator deactivation signal from the decision module 502, according to an embodiment of the present invention. Further, the actuator control module 504 may be configured to activate and/or deactivate the actuator valve 302 of the radiator 312 using the controller 120 of the valve control box 108 based on the received actuator activation signal and/or the actuator deactivation signal, respectively.

The optimization result module 506 may be configured to enable the SMU 106 to monitor an energy consumption of the building 128 at predefined time periods based on the decisions and the sensed data stored at the database 122, according to an embodiment of the present invention. The predefined time periods may be, but not limited to, 24 hours, 1 hour, 1 minute, and so forth. Embodiments of the present invention are intended to include or otherwise cover any of the time periods defined by a user. The optimization result module 506 may be configured to divide a total number of the actuator valves 302 installed in the building 128 against the energy and water usage per minute of the building 128. The result may then enable the optimization result module 506 to determine a cost of running each of the actuator valves 302 per minute. Further, the optimization result module 506 may be configured to determine an energy saving of the building 128 by monitoring an amount of time taken each of the actuator valves 302 is closed against a total running time of the HVAC system 100 in the building 128. Based on the monitored amount of time, the optimization result module 506 may be configured to determine energy savings by the HVAC system 100.

Furthermore, the optimization result module 506 may be configured to generate a report. The generated report may comprise data such as, but not limited to, the energy consumption of the building 128, the cost of running the actuator valve 302 per minute, the energy saving of the building 128, the total running time of the HVAC system 100, and so forth. In another embodiment of the present invention, the optimization result module 506 may be further configured to predict a billing trend and energy consumption of the building 128 over time based on the data received by the SMU 106. In an embodiment of the present invention, the optimization result module 506 may be further configured to transmit the generated report to a user device (not shown) of the user. The report may be transmitted by using a technique such as, but not limited to, an email, a text message, a voice message, and so forth. Embodiments of the present invention are intended to include or otherwise cover any type of the technique for transmitting the report, including known, related art, and/or later developed technologies. The user may be, but not limited to, a resident of the building 128, a caretaker of the building 128, a maintenance agency, a third-party service provider, and so forth. Further, the user device may be, but not limited to, a mobile device, a smart phone, a tablet computer, a portable computer, a laptop computer, a desktop computer, a smart device, a smart watch, a smart glass, a Personal Digital Assistant (PDA), and so forth. Embodiments of the present invention are intended to include or otherwise cover any type of the user device, including known, related art, and/or later developed technologies.

Figure 6A:
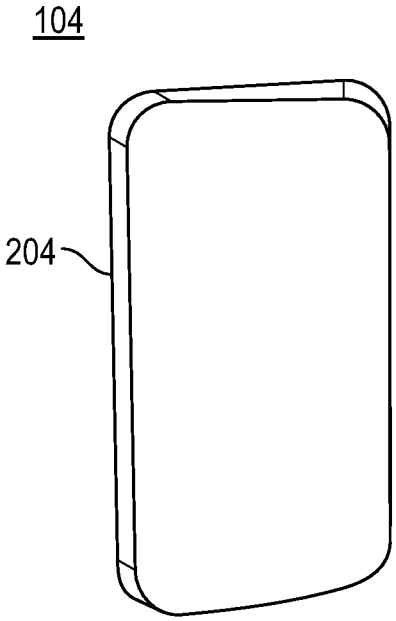
FIGS. 6A-6D illustrate a plurality of internal sensors, according to an embodiment of the present invention.

FIGS. 6A-6D illustrate the internal sensors 104, according to an embodiment of the present invention. FIG. 6A illustrates the window contact sensor 204, according to an embodiment of the present invention. The window contact sensor 204 may be utilized to determine if a window is open or closed in the virtual HVAC zones 134 (as shown in the FIG. 1D). The window contact sensor 204 may be, but not limited to, a battery operated Zigbee window sensor or any such window sensor known to a person skilled in the art. Further, a number of the window contact sensor 204 installed in the building 128 (as shown in the FIG. 2A) may be variable, according to an embodiment of the present invention.

Figure 6B:
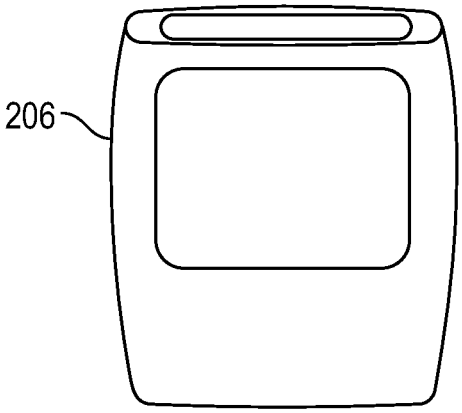

FIG. 6B illustrates the motion sensor 206, according to an embodiment of the present invention. The motion sensor 206 may be utilized to determine an occupancy status of the virtual HVAC zones 134. Further, the sensed data of the motion sensor 206 may be used by the management platform 124 to generate the one or more rules for controlling the operation of the HVAC system 100 based on the occupancy of the virtual HVAC zones 134. The sensed data may be a historical data accumulated by the motion sensor 206 over a time period of a week, two weeks, a month, and so forth. The motion sensor 206 may be, but not limited to, a battery operated Zigbee motion sensor or any such motion sensor known to a person skilled in the art. Further, a number of the motion sensor 206 installed in the building 128 may be variable, according to an embodiment of the present invention.

Figure 6C:
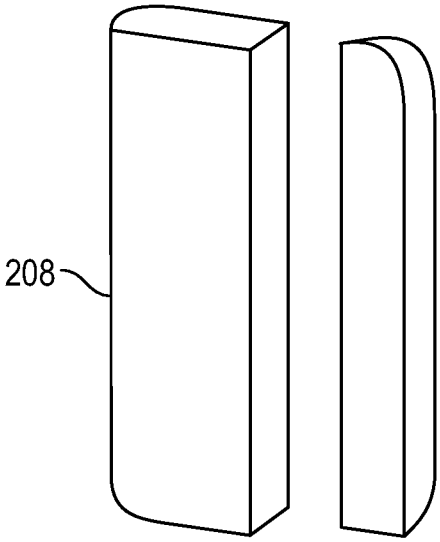

FIG. 6C illustrates the temperature/humidity sensor 208, according to an embodiment of the present invention. The temperature/humidity sensor 208 may be utilized to determine a temperature/humidity in the virtual HVAC zones 134 (as shown in the FIG. 1D). Further, the temperature/humidity sensor 208 may be, but not limited to, a battery operated Zigbee temperature/humidity sensor, or any such temperature/humidity sensor known to a person skilled in the art. Further, a number of the temperature/humidity sensor 208 installed in the building 128 may be variable, according to an embodiment of the present invention.

Figure 6D:
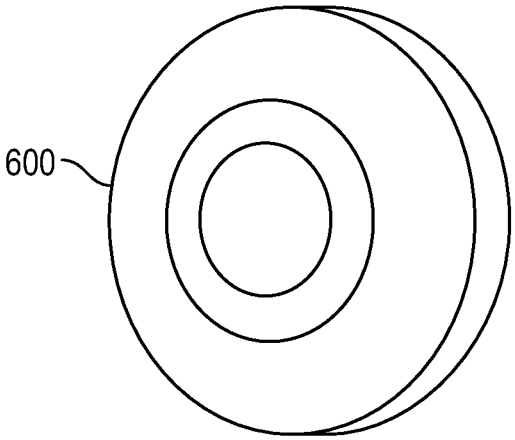

FIG. 6D illustrates the boiler/chiller sensor 600, according to an embodiment of the present invention. The boiler/chiller sensor 600 may be utilized to determine if the boiler/chiller installed in the basement 214 of the building 128 (as shown in the FIG. 2C) is on or off. The boiler/chiller sensor 600 may be, but not limited to, a battery operated Zigbee boiler/chiller sensor or any such boiler/chiller sensor known to a person skilled in the art. In an embodiment of the present invention, in case, no steam, hot water, chilled water or conditioned air is being provided in the building 128, then the battery operated actuators may be switched to a sleep mode in order to save energy. Further, a number of the boiler/chiller sensor 600 installed in the building 128 may be variable, according to an embodiment of the present invention.

Figure 7A:
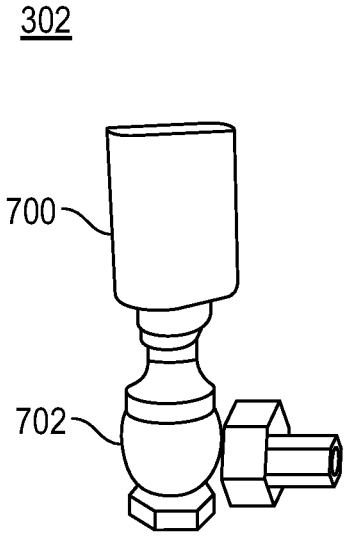
FIG. 7A illustrates an actuator valve, according to an embodiment of the present invention.

FIG. 7A illustrates the actuator valve 302, according to an embodiment of the present invention. The actuator valve 302 may be a one-way valve that may comprise a mount 700, and a valve 702. The mount 700 may be utilized for connecting the actuator motor 304 with different types of interfaces. In an embodiment of the present invention, the mount 700 may be utilized for connecting the actuator motor 304 with 4 different types of interfaces. Further, the valve 702 may be connected to the radiator 312 (as shown in the FIG. 3). The actuator valve 302 may be, but not limited to, a battery operated Zigbee one-way actuator valve or any such one-way actuator valve known to a person skilled in the art. In an embodiment of the present invention, in case, no steam, hot water, chilled water or conditioned air is being provided in the building 128, then the battery operated actuator valve 302 may be switched to a sleep mode in order to save energy. Further, a number of the actuator valve 302 installed in the HVAC system 100 may be variable, according to an embodiment of the present invention. Further, a radio (not shown), a battery (not shown), and a controller (not shown) are in a separate box (not shown) to lessen the effects of heat put on the batteries and for better radio reception. The controller (not shown) may communicate with the SMU 106 to get commands to close or open valve for steam, hot water or chilled water.

Figure 7B:
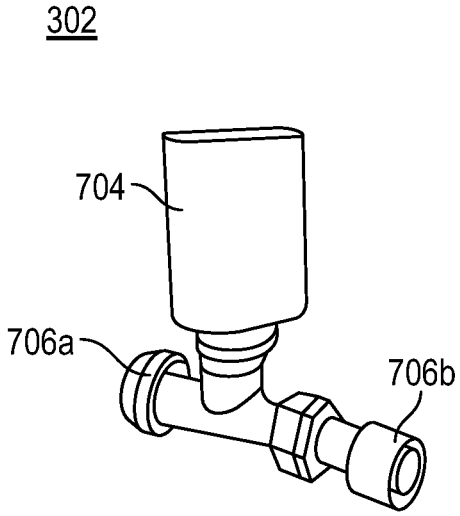
FIG. 7B illustrates the actuator valve, according to another embodiment of the present invention.
Figure 7C:
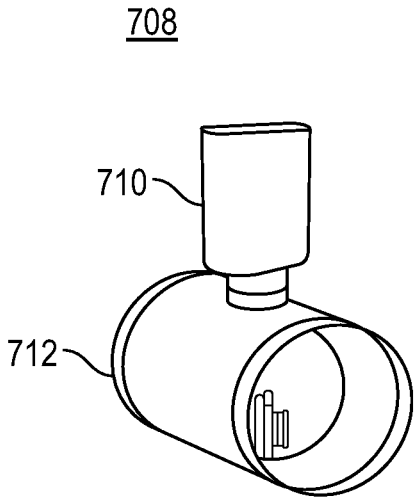
FIG. 7C illustrates an air damper valve, according to an embodiment of the present invention.

FIG. 7B illustrates the actuator valve 302, according to another embodiment of the present invention. The actuator valve 302 may be a multi way actuator valve comprising a mount 704 and a plurality of valves 706*a*-706*b* (hereinafter referred to as the valve 706). The mount 704 may be utilized for connecting the actuator motor 304 with different types of interfaces. In an embodiment of the present invention, the mount 704 may be utilized for connecting the actuator motor 304 with 4 different types of interfaces. The valve 706 may be connected to the radiator 312 (as shown in the FIG. 3). Further, a radio (not shown), a battery (not shown), and a controller (not shown) are in a separate box (not shown) to lessen the effects of heat put on the batteries and for better radio reception. The controller (not shown) may communicate with the SMU 106 to get commands to close or open valve for steam, hot water or chilled water.

FIG. 7C illustrates the air damper valve 708, according to an embodiment of the present invention. The air damper valve 708 may comprise a variable controlled motor 710, and a valve 712. The air damper valve 708 may be provided to regulate a flow of air inside a duct (not shown) of the virtual HVAC zones 134 (as shown in the FIG. 1D), according to an embodiment of the present invention. Further, the air damper valve 708 may be, but not limited to, a battery operated Zigbee air damper valve or any such air damper known to a person skilled in the art. Further, a number of the air damper valve 708 installed in the HVAC system 100 may be variable, according to an embodiment of the present invention. Further, a radio (not shown), a battery (not shown), and a controller (not shown) are in a separate box (not shown) to lessen the effects of heat put on the batteries and for better radio reception. The controller (not shown) may communicate with the SMU 106 to get commands to close or open valve for steam, hot water or chilled water.

Figure 8A:
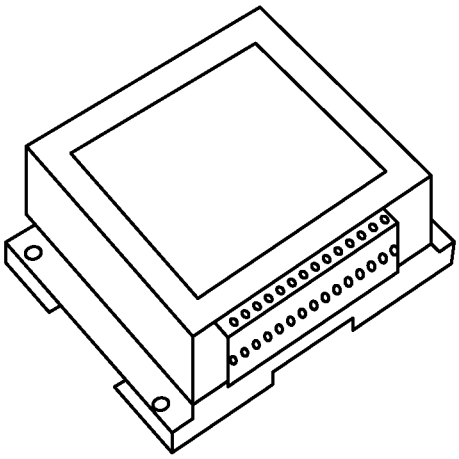
FIG. 8A illustrates a HVAC main unit controller, according to an embodiment of the present invention.
Figure 8B:
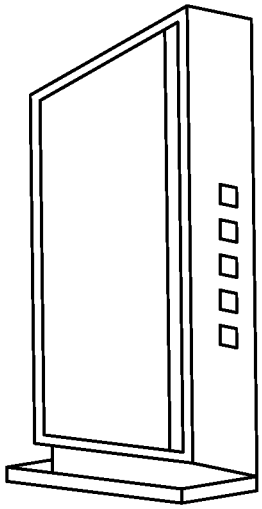
FIG. 8B illustrates a Building Management System (BMS) interface module, according to an embodiment of the present invention.

FIG. 8A illustrates a HVAC main unit controller 802, according to an embodiment of the present invention. The HVAC main unit controller 802 may be the controller 120 of the valve control box 108, in an embodiment of the present invention. The HVAC main unit controller 802 may be, but not limited to, a hardwired custom steam controller that may control switching on and/or off components such as, but not limited to, a boiler, a chiller and/or a air handler, the radiator 312, or any other such HVAC components and their speed, if required, known to a person skilled in the art. The HVAC main unit controller 802 may be used to control an operation of a heating and/or cooling producing components of the HVAC system 100 by communicating with the SMU 106.

FIG. 8B illustrates the BMS interface module 804, according to an embodiment of the present invention. The BMS interface module 804 may be, but not limited to, a hardwired BMS interface module or any other such BMS interface module known to a person skilled in the art. The BMS interface module 804 may be used to interact with the components of the HVAC system 100 and connect the components to multiple protocols the BMS interface module 804 communicates over, i.e. a BACnet, a Modbus, and so forth.

Figure 8C:
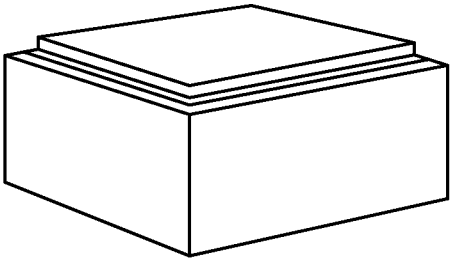
FIG. 8C illustrates the SMU, according to an embodiment of the present invention.

FIG. 8C illustrates the SMU 106, according to an embodiment of the present invention. The SMU 106 may be configured to receive the sensed data from the external sensors 102, the internal sensors 104, and transmit the sensed data to the LCU 110, as discussed in conjunction with the FIG. 1A.

Figure 8D:
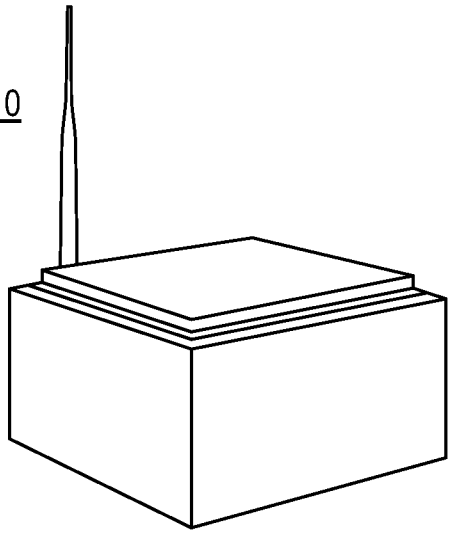
FIG. 8D illustrates a Lobby Control Unit (LCU), according to an embodiment of the present invention.

FIG. 8D illustrates the LCU 110, according to an embodiment of the present invention. The LCU 110 may be configured to transmit the sensed data received from the SMU 106 to the cloud server 112 for processing, as discussed in conjunction with the FIG. 1A.

Figure 9:
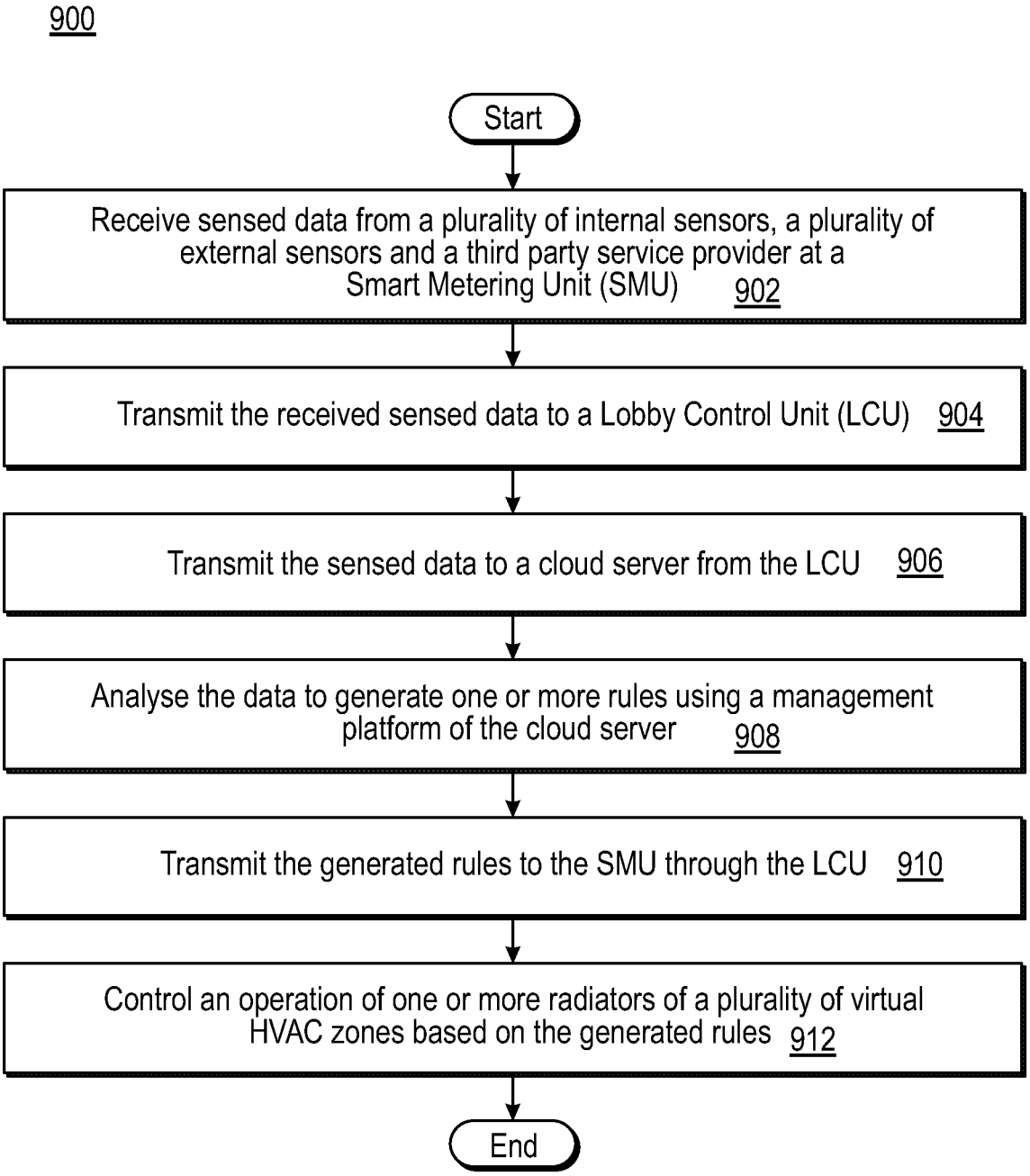
FIG. 9 illustrates a flowchart of a method for controlling and optimizing the HVAC system, according to embodiments of the present invention.

FIG. 9 illustrates a flowchart of a method 900 for controlling and optimizing the HVAC system 100, according to embodiments of the present invention.

At step 902, the HVAC system 100 may enable the SMU 106 installed on the floors 130 of the building 128 to receive sensed data from the external sensors 102, the internal sensors 104, and the third-party service provider.

At step 904, the HVAC system 100 may enable the SMU 106 to transmit the received sensed data to the LCU 110 installed in the lobby 132 of the building 128 through the repeaters 210 over the communication network 114.

Next, at step 906, the HVAC system 100 may enable the LCU 110 to transmit the sensed data to the cloud server 112 through the communication technique or a network such as, but not limited to, wireless communication technique or any other such technique known to a person skilled in the art.

At step 908, the HVAC system 100 may enable the management platform 124 of the cloud server 112 to analyze the sensed data and to generate one or more rules for controlling the operations of the HVAC system 100.

Next, at step 910, the HVAC system 100 may enable the LCU 110 to transmit the generated rules received from the cloud server 112 to the SMU 106 over the communication network 114.

At step 912, the HVAC system 100 may enable the SMU 106 to control the operations of the HVAC system 100 by activating and/or deactivating the actuator valve 302 of the radiator 312 for turning on and/or turning off the heating and/or the cooling of the virtual HVAC zones 134.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to firearms. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A Heating, Ventilation, and Air-Conditioning (HVAC) system comprising:

a plurality of external sensors to sense data associated with one or more external variables associated with an external environment of a building;

a plurality of internal sensors configured to sense data associated with one or more internal variables from within the building;

a plurality of valve control boxes to control an operation of one or more actuator valves installed at one or more radiators and one or more air dampers of one or more virtual HVAC zones of the building; and a Smart Metering Unit (SMU) connected to one or more of the plurality of external sensors, one or more of the plurality of internal sensors, and one or more of the plurality of valve control boxes, wherein the SMU is configured to:

receive the sensed data from one or more of the plurality of external sensors and one or more of the plurality of internal sensors;

transmit, wirelessly, the received sensed data to a cloud server over a communication network;

receive one or more rules generated by a management platform of the cloud server, wherein the one or more rules are generated by the management platform by using an Artificial Intelligence (AI) algorithm;

the AI algorithm:

detecting an occupancy status of a given zone of the building based on motion sensor data;

detecting an open window of the given zone based on the sensed data;

training an AI model to predict an occupancy status of the given zone based on historic motion sensor data;

training the AI model to predict an amount time necessary to change the temperature of the given zone by a predetermined amount; and training the AI model to predict times at which a side of the building is exposed to sunlight;

generating the one or more rules to control a temperature of the given zone based on the occupancy status, the detected open window, the predicted occupancy status, the predicted amount time necessary to change the temperature, and the predicted times at which a side of the building is exposed to sunlight; and transmit the received one or more rules to the one or more of the plurality of valve control boxes to control the operation of the one or more actuator valves installed at the one or more radiators and the one or more air dampers to control heating and cooling of the one or more virtual HVAC zones of the building;

wherein the SMU is configured to monitor an amount of time taken by the valve control boxes to actuate the one or more valves and a cost of running the one or more valves per unit of time, and determine a cost of running each of the one or more valves against a total energy consumption of the HVAC system; and wherein the SMU is further configured to determine an energy saving of the building based on the cost of running each of the one or more valves against the total energy consumption of the HVAC system.

2. The system of claim 1, wherein the SMU is further configured to store the sensed data at a database.

3. The system of claim 1, wherein the SMU is further configured to determine an action to be performed based on the sensed data and the one or more rules generated by the management platform using the AI algorithm.

4. The system of claim 1, wherein the SMU is further configured to monitor an energy consumption of the building at a predefined time.

5. The system of claim 1, wherein the SMU is further configured to generate a report comprising a cost of running the one or more actuator valves per minute, an energy saving of the building, and/or a total running time of the HVAC system.

6. The system of claim 1, wherein SMU is further configured to predict a billing trend and energy consumption in the building.

7. A method for controlling a Heating, Ventilation, and Air-Conditioning (HVAC) system, the method comprising:

receiving sensed data associated with one or more external variables of a building from one or more of a plurality of external sensors, and sensed data associated with one or more internal variables of the building from one or more of a plurality of internal sensors at a Smart Metering Unit (SMU);

transmitting, wirelessly, the received sensed data to a cloud server over a communication network, wherein the communication network is a self-healing secured network with a built-in route optimization;

receiving one or more rules generated by a management platform of the cloud server, wherein the one or more rules are generated by the management platform by using an Artificial Intelligence (AI) algorithm;

the AI algorithm:

detecting an occupancy status of a virtual HVAC zone of the building based on motion sensor data;

detecting an open window of the virtual HVAC zone based on the sensed data;

training an AI model to predict an occupancy status of the virtual HVAC zone based on historic motion sensor data;

training the AI model to predict an amount time necessary to change the temperature of the virtual HVAC zone by a predetermined amount; and training the AI model to predict times at which a side of the building is exposed to sunlight; and generating the one or more rules to control a temperature of the virtual HVAC zone based on the occupancy status, the detected open window, the predicted occupancy status, the predicted amount time necessary to change the temperature, and the predicted times at which a side of the building is exposed to sunlight; and transmitting the received one or more rules to a plurality of valve control boxes to control an operation of one or more actuator valves installed at one or more radiators and one or more air dampers to control heating and cooling of one or more virtual HVAC zones of the building;

wherein the SMU is configured to monitor an amount of time taken by the valve control boxes to actuate the one or more valves and a cost of running the one or more valves per unit of time, and determine a cost of running each of the one or more valves against a total energy consumption of the HVAC system; and wherein the SMU is further configured to determine an energy saving of the building based on the cost of running each of the one or more valves against the total energy consumption of the HVAC system.

8. The method of claim 7, further comprising storing the sensed data at a database.

9. The method of claim 7, further comprising enabling the SMU to determine an action to be performed based on the sensed data and the one or more rules generated by the management platform using the AI algorithm.

10. The method of claim 7, further comprising enabling the SMU to monitor an energy consumption of the building at a predefined time.

11. The method of claim 7, further comprising enabling the SMU to generate a report comprising one of, an energy consumption of the building, a cost of running the one or more actuator valves per minute, an energy saving of the building, the total running time of the HVAC system.

12. A computing device configured to operate as a computer-implemented control and optimization tool for a Heating, Ventilation, and Air-Conditioning (HVAC) system, comprising:

one or more processors; and one or more non-transitory computer-readable storage media storing instructions which, when executed by the one or more processors, cause the computing device to:

receive sensed data associated with one or more external variables of a building from one or more of a plurality of external sensors, and sensed data associated with one or more internal variables of the building from one or more of a plurality of internal sensors at a Smart Metering Unit (SMU);

transmit, wirelessly, the received sensed data to a cloud server through a Lobby Control Unit (LCU) installed in the building over a communication network, wherein the communication network is a self-healing secured network with a built-in route optimization;

receive one or more rules generated by a management platform of the cloud server through the LCU, wherein the one or more rules are generated by the management platform by using an Artificial Intelligence (AI) algorithm;

the AI algorithm:

detecting an occupancy status of a virtual HVAC zone of the building based on motion sensor data;

detecting an open window of the virtual HVAC zone based on the sensed data;

training an AI model to predict an occupancy status of the virtual HVAC zone based on historic motion sensor data;

training the AI model to predict an amount time necessary to change the temperature of the virtual HVAC zone by a predetermined amount; and training the AI model to predict times at which a side of the building is exposed to sunlight; and generating the one or more rules to control a temperature of the virtual HVAC zone based on the occupancy status, the detected open window, the predicted occupancy status, the predicted amount time necessary to change the temperature, and the predicted times at which a side of the building is exposed to sunlight; and transmit the received one or more rules to a plurality of valve control boxes to control an operation of one or more actuator valves installed at one or more radiators to control eating and cooling of one or more virtual HVAC zones of the building;

wherein the SMU is configured to monitor an amount of time taken by the valve control boxes to actuate the one or more valves and a cost of running the one or more valves per unit of time, and determine a cost of running each of the one or more valves against a total energy consumption of the HVAC system; and wherein the SMU is further configured to determine an energy saving of the building based on the cost of running each of the one or more valves against the total energy consumption of the HVAC system.

13. The device of claim 12, further configured to store the sensed data at a database.

14. The device of claim 12, further configured to determine an action to be performed based on the sensed data and the one or more rules generated by the management platform using the AI algorithm.

15. The device of claim 12, wherein the one or more rules are selected from one of, a first rule signal, a second rule signal, a third rule signal, a temperature raise time, a temperature fall time, and a basement actuator activation time, or a combination thereof.

16. The device of claim 12, further configured to monitor an energy consumption of the building at predefined time.

17. The device of claim 12, further configured to generate a report comprising one of, an energy consumption of the building, a cost of running the one or more actuator valves per minute, an energy saving of the building, a total running time of the HVAC system.

* * * * *